US007236720B2

(12) United States Patent
Nakazato et al.

(10) Patent No.: US 7,236,720 B2
(45) Date of Patent: Jun. 26, 2007

(54) IMAGE FORMING APPARATUS AND PROCESS CARTRIDGE

(75) Inventors: Yasushi Nakazato, Tokyo (JP); Masanori Horike, Kanagawa (JP); Yohichiroh Miyaguchi, Kanagawa (JP); Nobuaki Kondoh, Kanagawa (JP); Katsuo Sakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 173 days.

(21) Appl. No.: 11/011,193

(22) Filed: Dec. 15, 2004

(65) Prior Publication Data

US 2005/0158073 A1 Jul. 21, 2005

(30) Foreign Application Priority Data

Dec. 19, 2003 (JP) ..... 2003-422783

(51) Int. Cl.
*G03G 21/18* (2006.01)

(52) U.S. Cl. ..... 399/111; 399/252

(58) Field of Classification Search ..... None
See application file for complete search history.

(56) References Cited

U.S. PATENT DOCUMENTS

| | | | |
|---|---|---|---|
| 4,281,051 | A | 7/1981 | Sakai |
| 4,335,194 | A | 6/1982 | Sakai |
| 4,384,033 | A | 5/1983 | Sakai |
| 4,407,917 | A | 10/1983 | Sakai |
| 4,521,502 | A | 6/1985 | Sakai et al. |
| 4,544,935 | A | 10/1985 | Sakai |
| 4,615,607 | A | 10/1986 | Yanagawa et al. |
| 4,655,579 | A | 4/1987 | Adachi et al. |
| 4,664,501 | A | 5/1987 | Koizumi et al. |
| 4,690,541 | A | 9/1987 | Sakai et al. |
| 4,855,754 | A | 8/1989 | Tanaka et al. |
| 4,876,606 | A | 10/1989 | Banno et al. |
| 4,924,320 | A | 5/1990 | Tanaka et al. |
| 4,933,727 | A | 6/1990 | Mizuma et al. |
| 4,956,678 | A | 9/1990 | Kiya et al. |
| 5,095,371 | A | 3/1992 | Tanaka et al. |
| 5,121,170 | A | 6/1992 | Bannai et al. |
| 5,194,879 | A | 3/1993 | Kotabe et al. |

(Continued)

FOREIGN PATENT DOCUMENTS

| | | |
|---|---|---|
| JP | 11-288194 | 10/1999 |

(Continued)

OTHER PUBLICATIONS

U.S. Appl. No. 11/370,057, filed Mar. 8, 2006, Yamada et al.

(Continued)

*Primary Examiner*—Vincent Q. Nguyen
(74) *Attorney, Agent, or Firm*—Oblon, Spivak, McClelland, Maier & Neustadt, P.C.

(57) ABSTRACT

An image forming apparatus is disclosed that is able to improve transfer efficiency and image quality. The image forming apparatus includes an organic photo-conductor with latent images formed thereon, and a developing unit for developing the latent images. The organic photo-conductor has surface friction coefficient less than or equal to 0.3. The developing unit develops the latent images while transporting a two-composition developing agent including a toner T and a carrier C by a traveling wave electric field.

25 Claims, 16 Drawing Sheets

U.S. PATENT DOCUMENTS 5,204,716 A 4/1993 Kasahara et al.
5,386,272 A 1/1995 Nakazato
5,464,200 A 11/1995 Nakazato et al.
5,482,265 A 1/1996 Nakazato et al.
5,606,408 A 2/1997 Yano et al.
5,638,159 A 6/1997 Kai et al.
5,715,500 A 2/1998 Nakazato et al.
5,740,494 A 4/1998 Shoji et al.
5,765,087 A 6/1998 Yano et al.
5,955,228 A 9/1999 Sakai et al.
6,034,792 A 3/2000 Nakazato et al.
6,236,820 B1 5/2001 Nakazato et al.
6,295,435 B1 9/2001 Shinohara et al.
6,295,437 B1 * 9/2001 Hodoshima et al. ..... 399/346
6,345,170 B1 2/2002 Nakazato et al.
6,381,435 B2 4/2002 Shinohara et al.
6,400,917 B2 6/2002 Nakazato et al.
6,454,901 B1 * 9/2002 Sekiya et al. ..... 162/111
6,466,754 B2 10/2002 Nakazato et al.
6,470,169 B2 10/2002 Nakazato
6,580,887 B2 6/2003 Nakazato et al.
6,597,884 B2 7/2003 Miyaguchi et al.
6,597,887 B2 7/2003 Sakai et al.
6,697,588 B2 2/2004 Nakazato et al.
6,708,014 B2 3/2004 Miyaguchi et al.
6,721,523 B2 4/2004 Sugiura et al.
6,760,557 B2 7/2004 Nakazato et al.
6,768,886 B2 7/2004 Nakazato et al.
6,799,012 B2 9/2004 Shakuto et al.
6,819,892 B2 11/2004 Nakazato et al.
2001/0033755 A1 * 10/2001 Ino et al. ..... 399/49
2003/0039494 A1 2/2003 Shakuto et al.
2003/0210928 A1 11/2003 Miyaguchi et al.
2004/0013442 A1 1/2004 Suzuki et al.
2004/0042823 A1 3/2004 Sugiura et al.
2004/0057059 A1 3/2004 Miura et al.
2004/0076448 A1 4/2004 Nakazato et al.
2004/0076449 A1 4/2004 Nakazato et al.
2004/0105710 A1 6/2004 Shakuto et al.
2004/0156655 A1 8/2004 Miyaguchi et al.
2004/0191663 A1 * 9/2004 Ojima et al. ..... 430/110.3
2004/0197122 A1 10/2004 Nakano et al.
2004/0213800 A1 10/2004 Watanabe et al.
2004/0223783 A1 11/2004 Nakazato et al.
2004/0240907 A1 12/2004 Miyaguchi et al.
2005/0158073 A1 7/2005 Nakazato et al.

FOREIGN PATENT DOCUMENTS

JP 2000315013 A * 11/2000
JP 2001-34048 2/2001
JP 2002-307740 10/2002
JP 2002-341656 11/2002

OTHER PUBLICATIONS

U.S. Appl. No. 11/370,823, filed Mar. 9, 2006, Nakagawa et al.
U.S. Appl. No. 11/376,434, filed Mar. 16, 2006, Takahashi et al.
U.S. Appl. No. 11/481,914, filed Jul. 7, 2006, Tsukamoto.
U.S. Appl. No. 11/481,822, filed Jul. 7, 2006, Sakai et al.
U.S. Appl. No. 11/493,816, filed Jul. 27, 2006, Takahashi et al.
U.S. Appl. No. 11/546,251, filed Oct. 12, 2006, Tsukamoto et al.

* cited by examiner

Va (PHASE A)

Vb (PHASE B)

Vc (PHASE C)

CIRCUMFERENTIAL LENGTH: L1
PARTICLE PROJECTING AREA: S

CIRCLE OF AREA S
CIRCUMFERENTIAL LENGTH: L2

ROUNDNESS = L2 / L1

IMAGE FORMING APPARATUS AND PROCESS CARTRIDGE

BACKGROUND OF THE INVENTION

1. Field of the Invention

The present invention relates to an image forming apparatus and a process cartridge.

2. Description of the Related Art

In an image forming apparatus, such as a printer, a copier, or a fax machine, an electrophotographic process is used to form latent images on an image carrier, a developing agent powder (referred to as a "toner" below) is attached to the latent images to develop the latent images into visible toner images. These toner images are transferred to a recording medium (including intermediate transferring members), and target images are formed.

FIG. 19 illustrates an example of a developing device for attaching the toner to the electrostatic latent images formed on the image carrier in the aforementioned image forming apparatus. As illustrated in FIG. 19, a developing roller 1002, to which a DC bias voltage is applied by a developing bias power supply 1003, is controlled to rotate at a speed V3 and is brought into contact with an image carrier 1001 rotating at a speed V1, and the toner particles, which are held on the developing roller 1002 by carriers C, are transferred to the latent images for developing. This is a so-called "two-composition contacting developing device".

FIG. 20 illustrates another example of the developing device for attaching the toner to the electrostatic latent images on the image carrier.

As illustrated in FIG. 20, a developing roller 1004, to which a DC bias voltage is applied by a developing bias power supply 1005, is brought into contact with an image carrier 1001, and the toner, which is held on the developing roller 1004, is transferred to the latent images for developing. This is a so-called "one composition contacting developing device".

There are still other methods of attaching the toner.

FIG. 21 illustrates still another example of applying the toner to the electrostatic latent images on the image carrier.

As illustrated in FIG. 21, a toner cloud is formed near the surface of an image carrier 1001, and the toner T in the form of cloud is attached to the latent images on the image carrier. This is a so-called "toner cloud method".

FIG. 22 illustrates yet another example of attaching the toner to the electrostatic latent images on the image carrier.

As illustrated in FIG. 22, a DC bias voltage and an AC bias voltage are applied to the developing roller 1011 by a DC bias power supply 1012 and an AC bias power supply 1013, respectively, and an alternating electric field is formed between the image carrier 1001 and the developing roller 1011, thereby, the toner T held on the developing roller 1011 is jumped between the image carrier 1001 and the developing roller 1011, and thus the toner T is attached on the latent images for developing. This is a so-called "AC bias method".

The inventors of the present invention have proposed a developing device used in the above image forming apparatus. The developing device has an electrostatic transportation device for transporting a developing agent and attaching the developing agent to the image carrier. The electrostatic transportation device includes a transportation substrate in which plural transportation electrodes are arranged on a supporting substrate, these transportation electrodes are repeatedly arranged along the direction substantially perpendicular to the moving direction, and are substantially in parallel to each other at predetermined intervals. These transportation electrodes generate an electrostatic force to move the developing agent. Reference can be made to Japanese Laid-Open Patent Application No. 2002-341656 and Japanese Laid-Open Patent Application No. 2002-307740 (referred to hereinafter as reference 1 and reference 2, respectively).

On the other hand, organic photo-conductors are presently widely used as image carriers, because the organic photo-conductors have high photo sensitivity and are low in price. The surface friction coefficient of an organic photo-conductor is determined by material properties of the organic photo-conductor, and generally it is in a range from 0.3 to 0.6. When transferring the toner to a piece of paper or an intermediate transferring member, if the toner adheres to the photo-conductor due to a non-electrostatic adhesive force, the toner cannot be transferred by a transfer electric field; as a result, transfer efficiency is lowered and image quality degrades because of insufficient transfer.

To solve this problem, a lubricant agent is introduced to reduce the non-electrostatic adhesive force, and in turn to reduce the surface friction coefficient. Reference can be made to Japanese Laid-Open Patent Application No. 11-288194 and Japanese Laid-Open Patent Application No. 2001-34048 (referred to as reference 3 and reference 4, respectively, hereinafter).

When reducing the surface friction coefficient of the image carrier as described in reference 3 and reference 4, however, although the problem of insufficient transfer is solved, the developing performance declines and images of desired density cannot be formed when using the common two-composition contacting developing device or one-composition contacting developing device.

It is thought that this problem is attributed to reduction of the non-electrostatic adhesive force imposed on the toner on the image carrier, which counteracts magnetic particle chains occurring in development or a mechanical scavenging effect (scraping effect) in a developing sleeve, and thus the toner falls off easily. As a result, by just reducing the surface friction coefficient of the image carrier, although transfer efficiency is improved, image quality degrades.

When the developing device employing the aforesaid toner cloud is used, the same problem occurs in that the toner adhering to the image carrier falls off easily. Hence, similarly, by just reducing the surface friction coefficient of the image carrier, although transfer efficiency is improved, image quality degrades.

When the developing device using the aforesaid AC bias is used, although the mechanical scavenging effect does not occur, the so-called electrical scavenging effect occurs; similarly, by just reducing the surface friction coefficient of the image carrier, although transfer efficiency is improved, image quality degrades.

As described in reference 4, the above problem can be alleviated more or less by setting the application time of the AC bias when attaching the toner to the image carrier long compared with the application time of the AC bias when removing the toner from the image carrier. However, because the AC bias is applied at the same time, the toner is also attached to the non-image portion of the latent image, which is not to be developed into an image, hence, the non-image portion is stained with the toner, that is, so-called scumming occurs.

Further, because of the scavenging effect, even when the surface friction coefficient of the image carrier is reduced, in practice, it is difficult to reduce the surface friction coefficient uniformly, and the surface friction coefficient changes with time. Especially, when the surface friction coefficient is less than 0.2, stripe-like unevenness occurs in the obtained image because of the non-uniform developing ability. For this reason, the surface friction coefficient has to be set in a range that does not cause the non-uniformity of the developing ability, and cannot be used in the range from 0.3 to 0.6. Therefore, transfer efficiency and cleaning efficiency cannot be improved sufficiently.

Recently, it is proposed to use a spherical toner produced by polymerization as the developing agent in order to improve transfer efficiency and cleaning efficiency. However, because the adhesive force between the spherical toner and the image carrier is even weaker, if the surface friction coefficient of the image carrier is reduced when the aforesaid toner cloud developing device or AC bias developing device is used, insufficient transfer occurs more easily.

SUMMARY OF THE INVENTION

Accordingly, it is a general object of the present invention to solve one or more problems of the related art.

A more specific object of the present invention is to provide an image forming apparatus and a process cartridge able to improve transfer efficiency and image quality.

According to a first aspect of the present invention, there is provided an image forming apparatus including an image carrying unit; and a developing unit configured to develop a latent image on the image carrying unit, wherein a surface friction coefficient of the image carrying unit is less than or equal to 0.3, and the developing unit attaches a developing agent transported by an electrostatic force to the image carrying unit to develop the latent image.

Preferably, the developing unit includes a transportation unit configured to generate a traveling wave electric field for transferring the developing agent, and the electric field does not remove the developing agent adhering to an image portion of the latent image from the image carrying unit.

Preferably, the developing unit generates an electric field between the image carrying unit and the transportation unit. The electric field directs the developing agent toward the image portion of the latent image on the image carrying unit, and directs the developing agent away from a non-image portion of the latent image on the image carrying unit. The non-image portion of the latent image is not to be developed into an image.

Preferably, a voltage applied on the transportation unit for generating the traveling wave electric field has an average value between a voltage on the image portion of the latent image and a voltage on the non-image portion of the latent image. Alternatively, a voltage applied on the transportation unit for generating the traveling wave electric field includes a pulse-shaped waveform, and a level in the pulse-shaped waveform for directing the developing agent from the transportation unit is between a voltage on the image portion of the latent image and a voltage on the non-image portion of the latent image.

Preferably, a surface layer of the image carrying unit includes a material for reducing the surface friction coefficient of the image carrying unit. Alternatively, the image forming apparatus further comprises an application unit configured to apply a material for reducing the surface friction coefficient on a surface of the image carrying unit.

Preferably, the material for reducing the surface friction coefficient includes a lamellar crystalline material. More preferably, the lamellar crystalline material includes a fluorine-based polymeric material, or the lamellar crystalline material includes a metallic soap.

Preferably, a roundness of the developing agent is from 0.96 to 1.00, more preferably, the developing agent is produced by polymerization.

Preferably, the surface friction coefficient of the image carrying unit is greater than or equal to 0.1.

According to a second aspect of the present invention, there is provided a process cartridge detachably attached to an image forming apparatus. The process cartridge includes an image carrying unit; and a developing unit configured to develop a latent image on the image carrying unit. A surface friction coefficient of the image carrying unit is less than or equal to 0.3, and the developing unit attaches a developing agent transported by an electrostatic force to the image carrying unit for developing the latent image.

According to a third aspect of the present invention, there is provided an image forming apparatus comprising a plurality of process cartridges for developing a latent image on an image carrying unit. Each of the process cartridges includes the image carrying unit; and a developing unit configured to develop the latent image, wherein a surface friction coefficient of the image carrying unit is less than or equal to 0.3, and the developing unit attaches a developing agent transported by an electrostatic force to the image carrying unit for developing the latent image.

According to the present invention, because the surface friction coefficient of the image carrying unit is less than or equal to 0.3, and the developing unit attaches a developing agent transported by an electrostatic force to the image carrying unit for developing the latent image, the scavenging effect does not happen, and the developing agent adhering to the image portion of the latent does not fall off before transfer even when the surface friction coefficient of the image carrying unit is less than or equal to 0.3; therefore, it is possible able to improve both transfer efficiency and image quality.

These and other objects, features, and advantages of the present invention will become more apparent from the following detailed description of preferred embodiments given with reference to the accompanying drawings.

DESCRIPTION OF THE PREFERRED EMBODIMENTS

Below, preferred embodiments of the present invention are explained with reference to the accompanying drawings.

Figure 1:
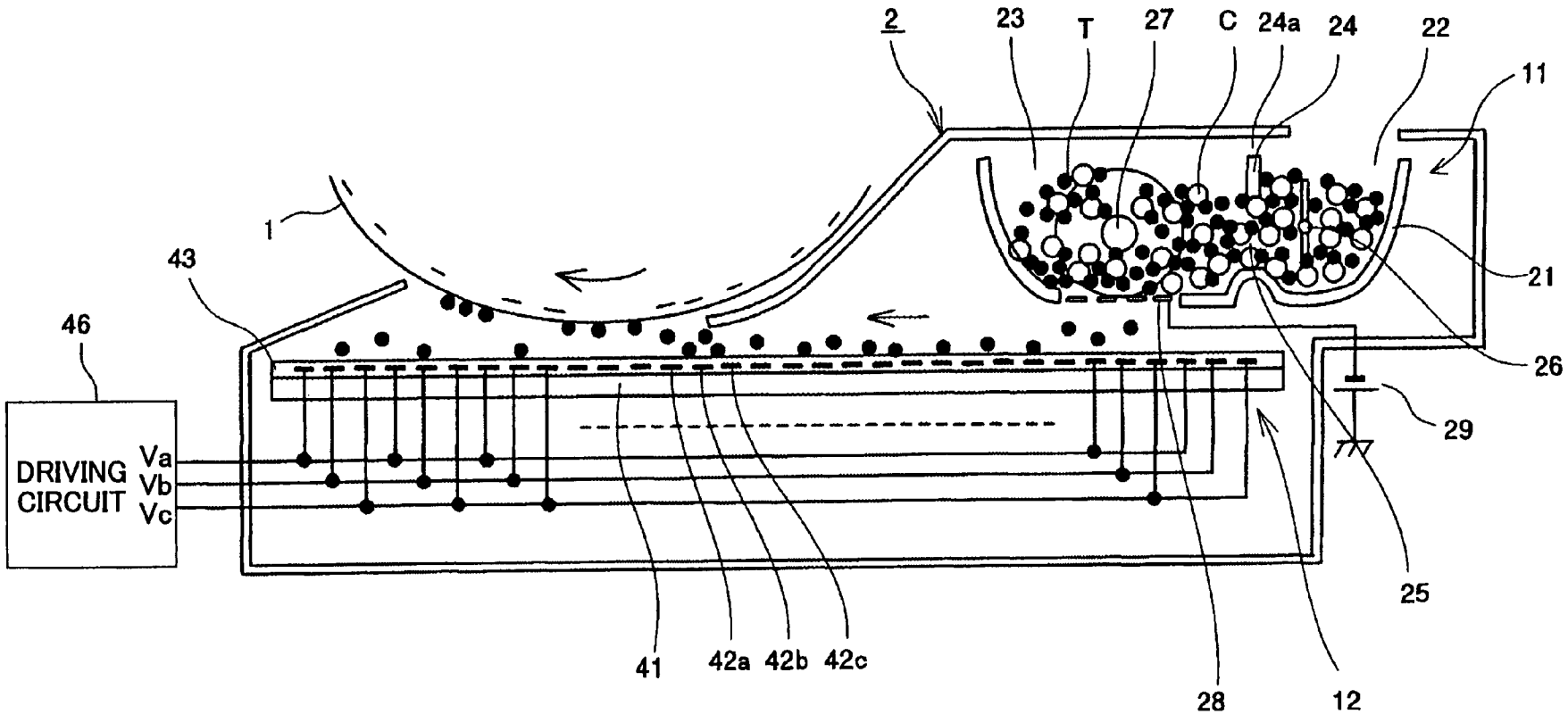
FIG. 1 is a view schematically showing a configuration of a developing portion of an image forming apparatus according to an embodiment of the present invention.

FIG. 1 is a view schematically showing a configuration of a developing portion of an image forming apparatus according to an embodiment of the present invention.

Figure 2:
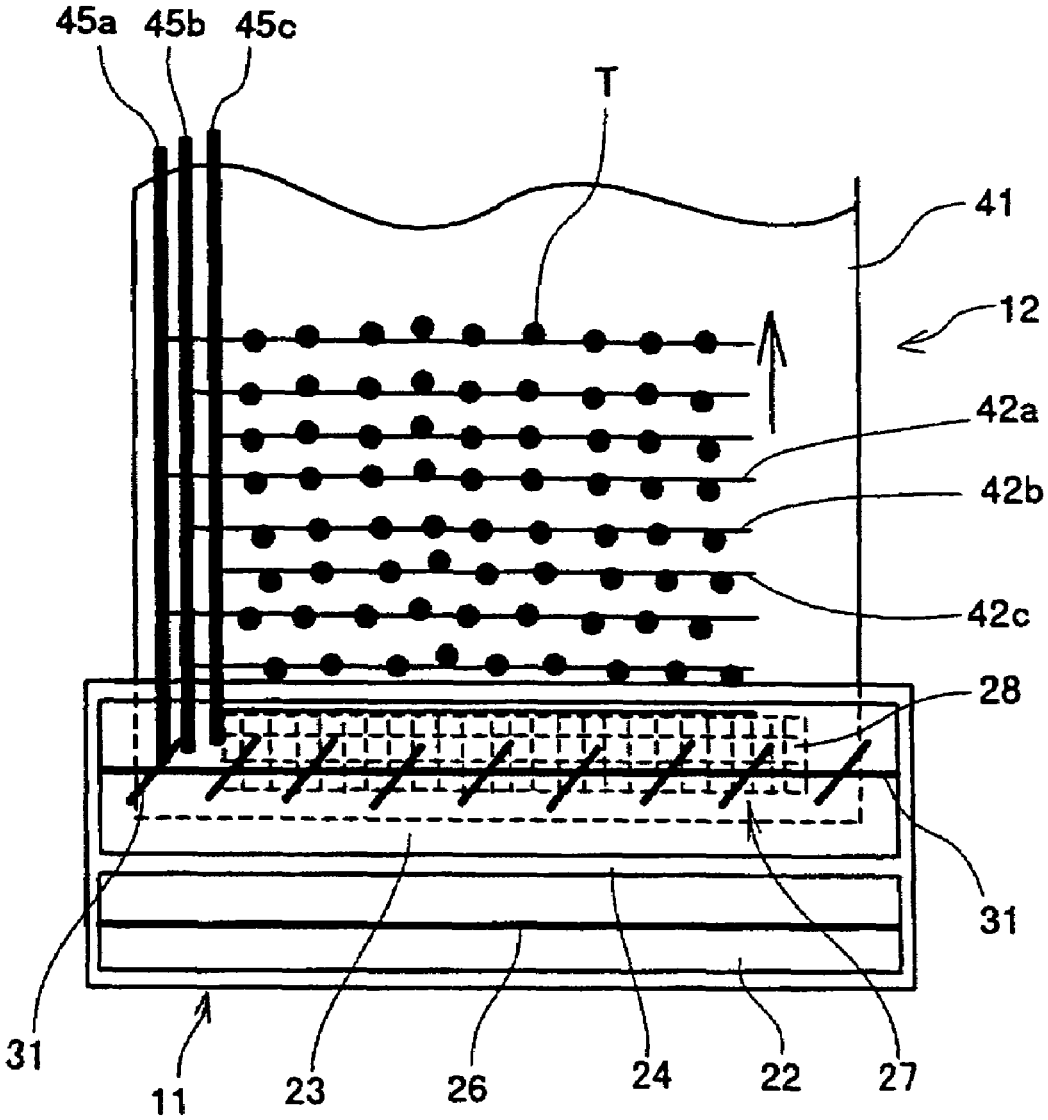
FIG. 2 is a plan view schematically showing the configuration of the developing portion of the image forming apparatus in FIG. 1.

FIG. 2 is a plan view schematically showing the configuration of the developing portion of the image forming apparatus as illustrated in FIG. 1.

The image forming apparatus includes an image carrier 1 including an organic photo-conductor with latent images formed thereon, and an electrostatic developing device 2 which develops the latent images on the image carrier 1 by using a two-composition developing agent including a toner T and a carrier C while transporting the toner T by a traveling wave electric field. That is, here, the developing device 2 is exemplified to be an electrostatic developing device. In FIG. 1, it is illustrated that the image carrier 1 is in a form of a drum, but the image carrier 1 can also be a belt.

Preferably, the surface friction coefficient of the image carrier 1 is less than or equal to 0.3, more preferably, the surface friction coefficient of the image carrier is greater than or equal to 0.1 and less than or equal to 0.3. Alternatively, a mechanism is provided to maintain the surface friction coefficient of the image carrier 1 to be less than or equal to 0.3, or greater than or equal to 0.1 and less than or equal to 0.3.

Figure 3:
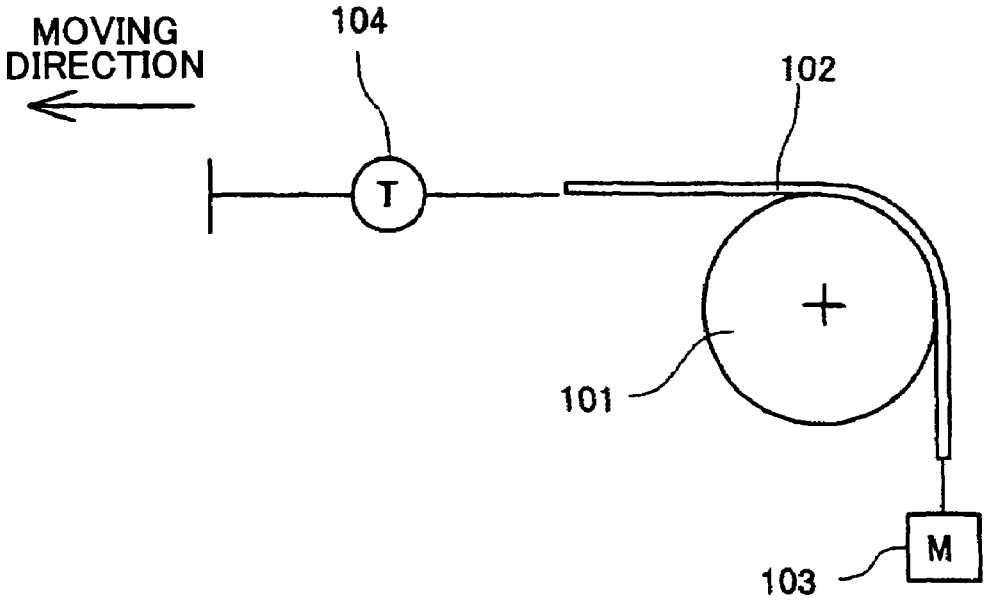
FIG. 3 is a view illustrating a method of measuring the friction coefficient of the image carrier 1.

For example, the friction coefficient can be measured by an oiler belt system, as illustrated in FIG. 3.

FIG. 3 is a view illustrating a method of measuring the friction coefficient of the image carrier 1.

The oiler belt system is a method capable of simply and precisely measuring the friction coefficient between a sheet of test paper and a photo-conductor. Specifically, as illustrated in FIG. 3, a sheet of test paper 102 is wound over a quarter (¼) of the circumference of the photo-conductor 104 of the image carrier 11, a plumb 103 of weight M is hung at an end of the test paper 102, and the test paper 102 is pulled at the other end in the horizontal direction through a tension gauge 104. If the maximum tension given by the tension gauge 104 is T, irrelevant to the diameter of the photo-conductor 104 and the width of the test paper 102, the friction coefficient μ can be expressed as follows:

$$\mu=(\mathrm{Loge}(T/M))/(\pi/2)$$

Figure 4:
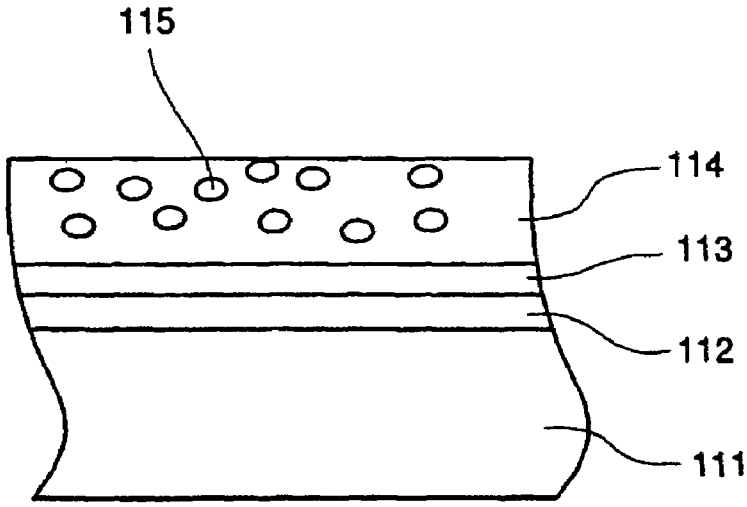
FIG. 4 is a view illustrating a configuration of a surface layer of the image carrier 1 for reducing the friction coefficient.

FIG. 4 is a view illustrating a configuration of a surface layer of the image carrier 1 for reducing the friction coefficient.

For example, in order to ensure that the surface friction coefficient of the image carrier 1 is in the range from 0.1 to 0.3, as illustrated in FIG. 4, the surface layer of the image carrier 1 may include a material for reducing the surface friction coefficient.

For example, the image carrier 1 is a stacked structure on the substrate 111 including a UL layer 112, a GCL layer 113, and a CTL layer 114, which are formed sequentially on the substrate 111. In the CTL layer 114, which is the surface layer, a material 115, which is capable of reducing the surface friction coefficient, is dispersed.

In this way, the material 115, which is exposed on the surface of the image carrier 1, is drawn on the surface, and thereby, the surface friction coefficient is reduced.

In the structure illustrated in FIG. 4, however, in order to expose the material 115 dispersed inside the surface layer of the image carrier 1 along with time, it is necessary to constantly abrade the surface of the image carrier 1, and hence, it is necessary to provide a cleaning abrader or other mechanisms able to abrade the surface. In addition, because the image carrier 1 is used while being abraded, and the thickness of the CTL layer 114 is usually very thin (about 20 to 30 μm), the service life of the image carrier 1 becomes relatively short.

For example, a mechanism may be provided to maintain the surface friction coefficient of the image carrier 1 to be in the range from 0.1 to 0.3, and the mechanism may be a device to apply the material for reducing the surface friction coefficient on the surface of the image carrier 1.

Figure 5:
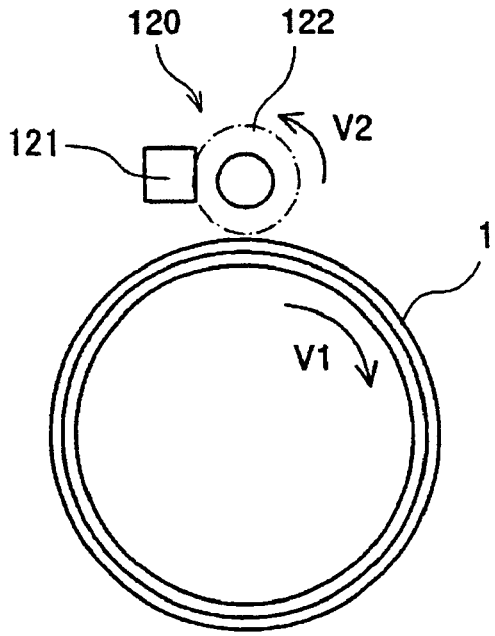
FIG. 5 is a view illustrating an example of a mechanism for applying the material for reducing the surface friction coefficient of the image carrier 1 on the surface of the image carrier 1.

FIG. 5 is a view illustrating an example of a mechanism for applying the material 115 for reducing the surface friction coefficient of the image carrier 1 on the surface of the image carrier 1.

As illustrated in FIG. 5, a device 120 is provided to apply materials on the surface of the image carrier 1, which includes a fur brush 122 to scratch fine powders of a lubricant agent 121 acting as the material 115 for reducing the surface friction coefficient, and to transport the fine powders of the lubricant agent 121 to the image carrier 1. The lubricant agent 121 is applied on the surface of the image carrier 1 while controlling the image carrier 1 to rotate at a speed V1, and the fur brush 122 to rotate at a speed V2 in the same contact direction as V1. Here, because the lubricant agent 121 is used for dry development, preferably, the lubricant agent 121 is a solid lubricant agent.

Figure 6:
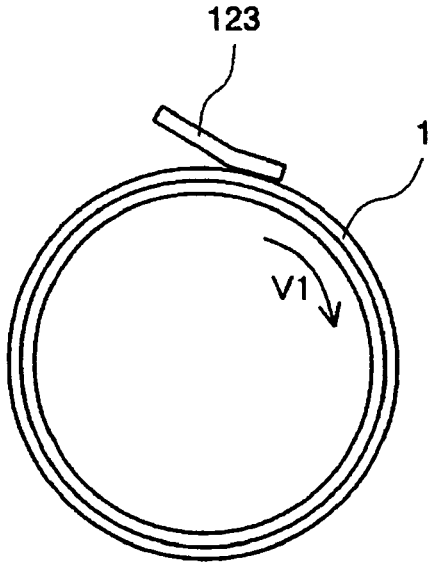
FIG. 6 is a view illustrating another example of the mechanism for applying the material for reducing the surface friction coefficient of the image carrier 1 on the surface of the image carrier 1.

FIG. 6 is a view illustrating another example of the mechanism for applying the material 115 for reducing the surface friction coefficient of the image carrier 1 on the surface of the image carrier 1.

As illustrated in FIG. 6, as the mechanism for applying a solid lubricant agent 124 in a form of a film or a pad, acting as the material for reducing the surface friction coefficient, the solid lubricant agent 124 may be directly placed in contact with the surface of the image carrier 1, and the lubricant agent 121 is applied on the surface of the image carrier 1 while controlling the image carrier 1 to rotate at a speed V1.

Although the mechanisms illustrated in FIG. 5 and FIG. 6 are very simple, they are able to effectively apply the material for reducing the surface friction coefficient because of a self-adjustment function of the mechanisms. Specifically, if the original friction coefficient is high, the solid lubricant agent is applied on the surface of the image carrier 1 due to the friction heat and the friction force; once the solid lubricant agent is applied, the frictional heat and the frictional force are reduced, the operation of applying the solid lubricant agent stops automatically. This realizes the self-adjustment function.

Preferably, the material for reducing the surface friction coefficient of the image carrier 1 includes a lamellar crystalline material, and more preferably, the lamellar crystalline material includes a lubricant material such as a fluorine-based polymeric material, or a metallic soap. Particularly, the solid lubricant agent may be zinc stearate (St-Zn), PFA, PTFE and the like. There are also other natural materials which can be used as the solid lubricant agent, such as a carnival wax, but when using the carnival wax, it is not easy to reduce the surface friction coefficient to be less than 0.2.

Figure 7:
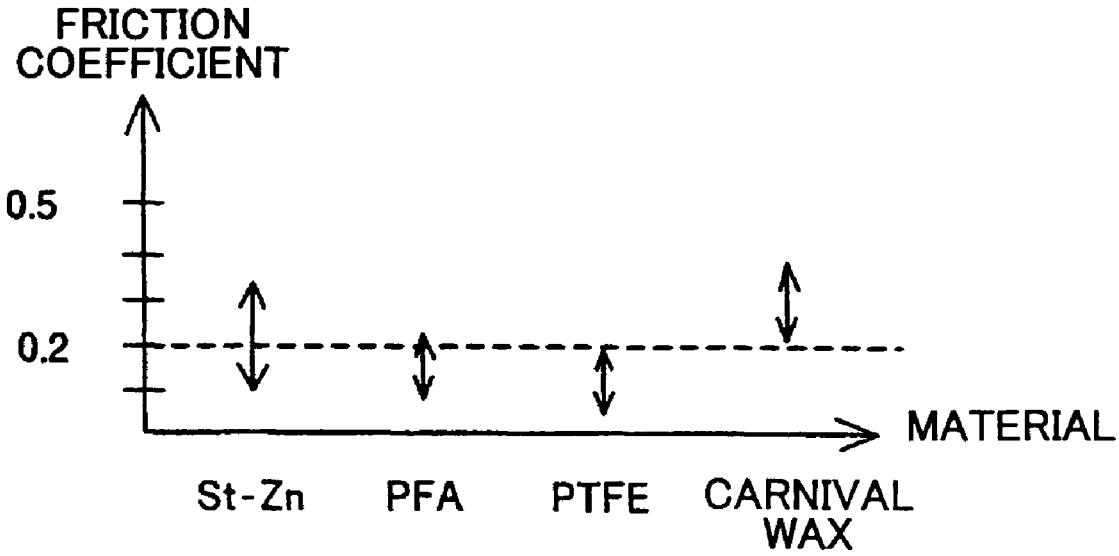
FIG. 7 shows friction coefficients related to zinc stearate (St-Zn), PFA, PTFE, and carnival wax.

FIG. 7 shows friction coefficients related to zinc stearate (St-Zn), PFA, PTFE, and the carnival wax. As illustrated in FIG. 7, the friction coefficients change within certain ranges, and this is because the friction coefficients change along with the amount of the lubricant agents applied on the surface of the image carrier 1, and change along with the structure of the process unit.

The amount of the applied lubricant agents changes only slightly, and in particular, when the friction coefficient is less than 0.2, it is difficult to quantitatively evaluate the amount of the applied lubricant agents, and it is preferable to define the lubricant conditions by using the friction coefficient as an index.

From the view of the lubricant properties, it is preferable to use PTFE as the lubricant agent when it is needed to reduce the surface friction coefficient of the image carrier 1 to be less than or equal to 0.2. Although it is possible to reduce the surface friction coefficient to be less than or equal to 0.2 by using zinc stearate (St-Zn) or PFA, it is necessary to pay much attention to the amount of the applied lubricant agents when using these materials.

Below, explanations are made of the structure of the developing device 2 with reference to FIG. 1 and FIG. 2, again.

The developing device 2 includes a toner supplier 11 for agitating the toner T and the carrier C, and a toner electrostatic transportation unit 12 for transporting the toner T supplied from the toner supplier 11 to a region of the image carrier 1 for developing the latent image on the image carrier 1.

The toner supplier 11 has a developing vessel 21 that contains a developing agent formed from the toner T and the carrier C. The developing vessel 21 has a toner hopper portion 22 into which the toner T is supplied from a not-illustrated toner cartridge, and an agitation bath 23 in which the toner T and the carrier C are agitated and charged, and a separation member 24 that separates the toner hopper portion 22 and the agitation bath 23.

An agitator 26 is rotably installed in the toner hopper portion 22 for agitating and transporting the developing agent (toner T and carrier C). An agitating and transportation screw 27 is installed in the agitation bath 23 without contacting the inner surface of the developing vessel 21, and a mesh electrode 28 is installed on the bottom of the agitation bath 23. The agitating and transportation screw 27 is a rotating member for agitating and frictionally charging the toner T and the carrier C transported from the toner hopper portion 22.

Here, the developing agent (the toner T and the carrier C) is supplied at one end of the agitating and transportation screw 27 in a longitudinal direction thereof and is transported to the other end. The agitating and transportation screw 27 uniformly mix the toner T and the carrier C (developing agent) when the developing agent is circulating from one end to the other end of the agitating and transportation screw 27.

Figure 8:
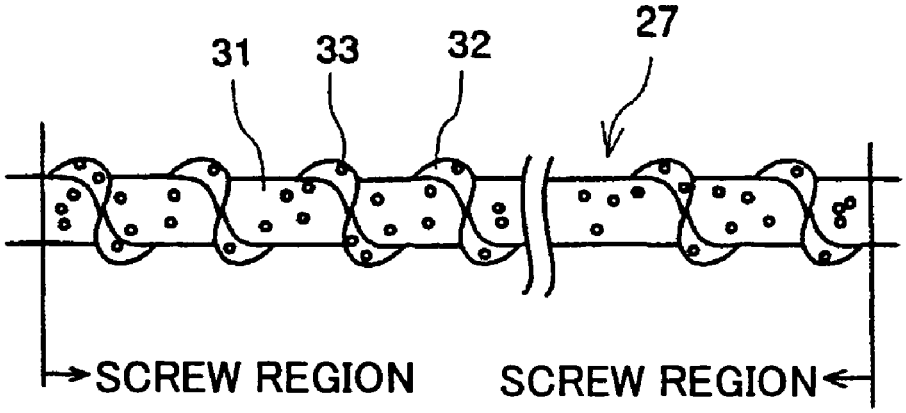
FIG. 8 is a view schematically showing a configuration of the agitating and transportation screw 27.

FIG. 8 is a view schematically showing a configuration of the agitating and transportation screw 27.

As illustrated in FIG. 8, in the agitating and transportation screw 27, a spiral screw portion 32 is formed on the circumferential surface of a main axle 31, and inorganic fine particles 33 able to charge the toner T are formed on the surface of the main axle is 31. For example, the inorganic fine particles 33 are formed by fabricating a film using a barium titanate glass powder (average particle diameter: 5 μm)) by means of high speed injection.

The agitating and transportation screw 27 can be formed from resin materials such as synthesized resin PE (polyethylene), PC (poly-carbonate), PETP (polyethylene terephtalate), PP (polypropylene), ABS (acrylonitrile butadiene styrene), or metals such as SUC, aluminum, iron, and copper, or alloys of them. In addition, a conductive film can be formed on the surfaces of the above resin materials.

It is required that the agitating and transportation screw 27 be formed from materials having small thermal deformation, superior thermal resistance, good adhesion to the toner and strength, and stability in dimension. Among the resin materials, those resins reinforced by carbon or glass fibers such as aramid fibers may be used, and the ABS resin/PC resin (including 30% glass fiber) are preferable because they are inexpensive and thermally stable.

In the toner electrostatic transportation unit 12, plural transportation electrodes are arranged on a base substrate (supporting substrate) 41 at preset intervals with every three transportation electrodes 42*a*, 42*b*, 42*c* (also referred to as "electrode 42" for simplicity where appropriate) as a group, and each of the transportation electrodes 42 is arranged along the direction perpendicular to a toner transportation direction (or toner proceeding direction, or toner moving direction) as indicated by the arrow in FIG. 2, and the plural transportation electrodes 42 are repeatedly arranged along the toner transportation direction. An insulating member 43 is stacked on the transportation electrodes 42 to form a transportation surface.

Figures 9A, 9B, 9C:
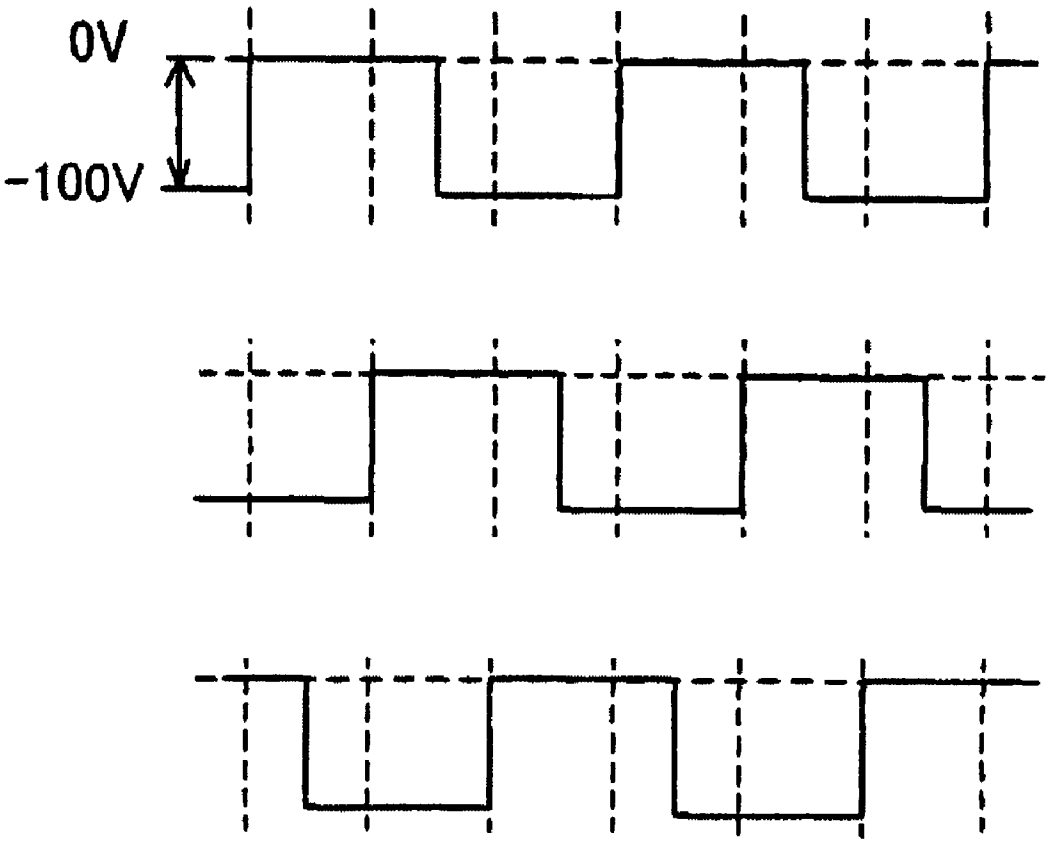
FIGS. 9A through 9C are waveforms of the driving voltages applied on the toner electrostatic transportation unit 12.

FIGS. 9A through 9C are waveforms of the driving voltages applied on the toner electrostatic transportation unit 12.

As illustrated in FIG. 2, ends of the transportation electrodes 42*a*, 42*b*, 42*c* are connected to common electrodes 45*a*, 45*b*, and 45*c*, respectively, and through the common electrodes 45*a*, 45*b*, and 45*c*, a driving circuit 46 applies three-phase (phase A, phase B, phase C) driving voltages Va, Vb, and Vc, as illustrated in FIGS. 9A through 9C, to the transportation electrodes 42*a*, 42*b*, 42*c*. Here, the driving voltages Va, Vb, and Vc are selected so that the toner T adhering to an image portion of the latent image on the image carrier 1 is not peeled off by the electric field generated by the transportation electrodes 42*a*, 42*b*, 42*c*.

Due to the driving voltages Va, Vb, and Vc having different phases from each other applied by the driving circuit 46 to the transportation electrodes 42*a*, 42*b*, 42*c* of the toner electrostatic transportation unit 12, a traveling wave electric field is generated, thereby, the developing agent supplied from the toner supplier 11 is transported, by an electrostatic force given by the toner electrostatic transportation unit 12, to the developing region of the image carrier 1. In the developing region of the image carrier 1, the latent image on the image carrier 1 is developed by an EH (electrostatic transport and hopping) phenomenon accompanying transportation and hopping.

Here, the EH phenomenon means that when powder particles are given energy by a phase transition electric field, the energy is converted into mechanical energy and makes the powder particles hop. The EH phenomenon includes movement (transportation) of the powder particles in a horizontal direction (that is, along a transportation surface) by the electrostatic force, and movement (hopping) of the powder particles in a perpendicular direction (that is, in a direction perpendicular to the transportation surface) by the electrostatic force, and due to the phase transition electric field, the powder particles bounce on the surface of an electrostatic transportation substrate carrying a component in the traveling direction. The developing technique employing this phenomenon is called "EH developing".

Because of the configurations shown in FIG. 1 and FIG. 2, in the image forming apparatus of the present embodiment, first, the toner T is replenished along a line entering the paper in FIG. 1 into the toner hopper portion 22 of the developing device 2 by the not-illustrated toner cartridge. At this time, the agitator 26, which is rotating clockwise, agitates and mixes the developing agent including the toner T and the carrier C and transports the developing agent (toner T and carrier C) to the agitation bath 23. At this moment, due to mixing and agitation, the toner T is partially charged.

Then, in the agitation bath 23, the agitating and transportation screw 27 rotates clockwise, agitates and charges the developing agent (toner T and carrier C) again. At this moment, a power supplier 29 applies a voltage on the mesh electrode 28 installed on the bottom of the agitation bath 23 to provide the same charge as those carried by the toner T to the mesh electrode 28. Therefore, at the mesh electrode 28, the same voltage as that on the toner T is imposed on the agitated, charged and transported developing agent (toner T and carrier C), and the toner electrostatic transportation unit 12, which is arranged further away than the opening of the mesh electrode 28, feeds out nearly uniform toner T absorbed (electrostatically held) on the surface of the carrier C.

Next, the toner T fed out by the toner electrostatic transportation unit 12 is moved by the traveling wave electric field generated when the driving voltages Va, Vb, and Vc having three different phases (phase A, phase B, phase C) are applied to the transportation electrodes 42*a*, 42*b*, 42*c* of the toner electrostatic transportation unit 12, thereby, transporting the developing agent to the developing region of the image carrier 1.

Then, in the developing region facing the image carrier 1, because the toner T adheres to the image portion of the latent image on the image carrier 1, but not to the non-image portion of the latent image, the latent image is developed, and a toner image is formed.

At this moment, because the driving voltages Va, Vb, and Vc are selected so that the toner T adhering to an image portion of the latent image on the image carrier 1 is not peeled off by the traveling wave electric field generated when the driving voltages Va, Vb, and Vc are applied on the transportation electrodes 42*a*, 42*b*, 42*c* of the toner electrostatic transportation unit 12, the electrical scavenging (scraping) effect does not happen.

Therefore, because the toner adhering to the image carrier 1 does not fall off even when the adhesive force of the toner is reduced by setting the surface friction coefficient of the image carrier 1 to be less than or equal to 0.3, more preferably, in the range from 0.1 to 0.3, an appropriate amount of the adhering toner can be obtained for forming images having desired density, thereby, image quality can be improved, and at the same time, the transfer efficiency can also be improved since the surface friction coefficient of the image carrier 1 is set to be less than or equal to 0.3, more preferably, in the range from 0.1 to 0.3.

Even when the surface friction coefficient of the image carrier 1 changes below 0.3, or in the range from 0.1 to 0.3, or even over 0.3, because the toner adhering to the image carrier 1 does not fall off, it is not necessary to change the developing ability to respond to the change of the surface friction coefficient of the image carrier 1.

In other words, as for the aforesaid developing method involving application of the AC bias voltage between the image carrier and the developing roller, as described in reference 4, by setting the application time when applying the toner to the image carrier to be longer than the application time when removing the toner from the image carrier, it is also possible to obtain a desired amount of adhering toner when the surface friction coefficient of the image carrier 1 is 0.2. However, as described above, it is difficult to constantly maintain the surface friction coefficient of the image carrier 1 to be 0.2.

Hence, when the surface friction coefficient of the image carrier 1 turns to be less than 0.2, the amount of adhering toner decreases, and when the surface friction coefficient of the image carrier 1 turns to be greater than 0.2, the amount of adhering toner increases. As a result, it is required to accordingly change the bias application time when applying the toner to the image carrier to be longer and the bias application time when removing the toner from the image carrier in order to respond to the change of the surface friction coefficient of the image carrier 1. However, because it is difficult to measure the surface friction coefficient of the image carrier 1 which is already in service use, it is practically impossible to change the bias application time.

In contrast, according to the electrostatic developing device 2 of the present embodiment, because effects that may cause fall-off of the toner adhering to the latent image on the image carrier 1 do not occur, it is not necessary to change the developing ability to respond to the change of the surface friction coefficient of the image carrier 1.

Concerning this point, inventors of the present invention performed experiments to investigate the relation between the friction coefficient of a photo-conductor and the developing density by using a half-tone image density manuscript.

Figure 10:
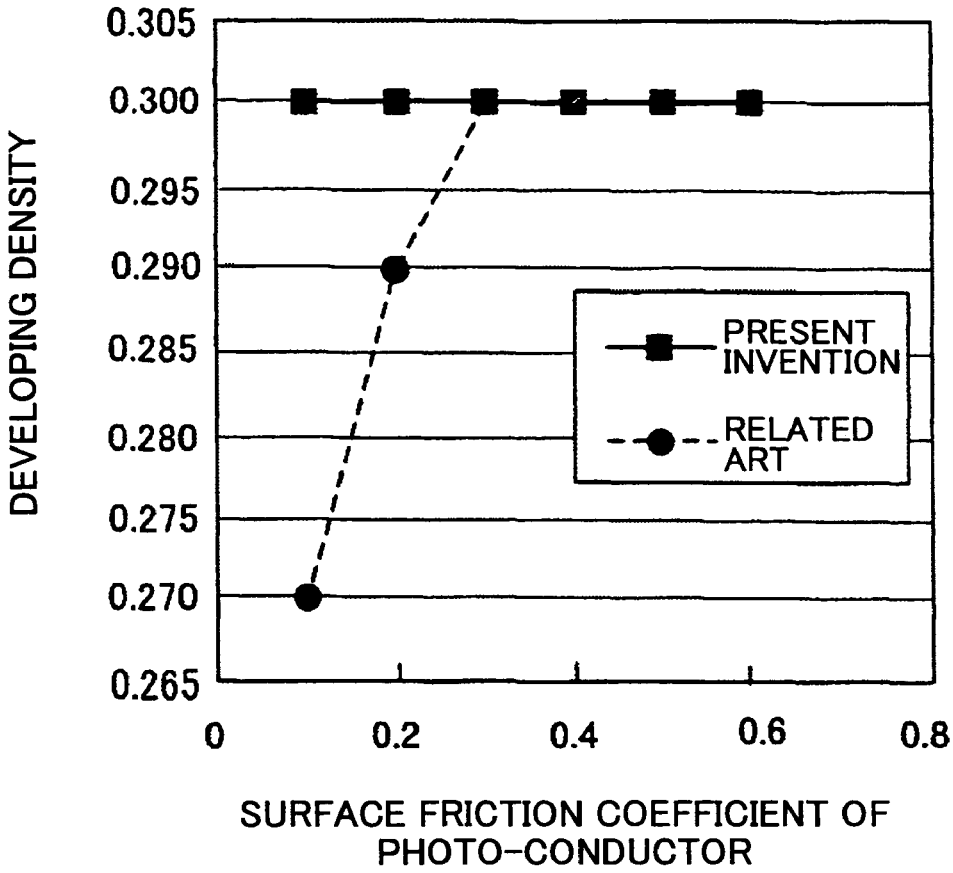
FIG. 10 shows experimental results of the relation between the friction coefficient of a photo-conductor and the developing density in the present embodiment and in the related art.

FIG. 10 shows experimental results of the relation between the friction coefficient of a photo-conductor and the developing density in the present embodiment and in the related art.

In FIG. 10, the results obtained by the AC bias developing method are indicated by a dashed line, and the results obtained by the present invention are indicated by a solid line.

When using the AC bias developing method, as shown in FIG. 10 by the dashed line, the developing density was quite low when the surface friction coefficient of the photo-conductor was in the range from 0.1 to 0.2, and this caused stripe-like unevenness in resulting images. That is to say, when the surface friction coefficient of the photo-conductor turns below 0.2 due to fluctuation of the friction coefficient, desired image quality cannot be obtained.

In contrast, when using the developing method of the present embodiment, as shown in FIG. 10 by the solid line, a stable developing density was obtained not only when the surface friction coefficient of the photo-conductor was greater than 0.2, but also when the surface friction coefficient of the photo-conductor was in the range from 0.1 to 0.2. Hence, according to the present embodiment, desired image quality can be obtained even when the surface friction coefficient of the photo-conductor fluctuates.

The adhesive force of the toner on the surface of the image carrier 1 decreases not only when the surface friction coefficient of the image carrier decreases, but also when a spherical toner is used. Because the developing device of the related art cannot decrease in performance even when the surface friction coefficient of the image carrier decreases, it is certain that the developing device of the related art cannot ensure sufficiently high performance when a spherical toner is also used in addition to a decrease of the surface friction coefficient of the image carrier.

In contrast, according to the electrostatic developing device 2 of the present embodiment, because sufficient developing can be performed even when the surface friction coefficient of the photo-conductor is so low as in the range from 0.1 to 0.2, it is also possible to perform sufficient developing and obtain desired image quality even when the spherical toner, which has a weak adhesive force, is used.

Below, explanations are given of developing particles as the toner used in the above image forming apparatus.

First, the roundness of the toner is described. For an image forming apparatus using spherical toner to obtain high image quality, it is important that the toner have a special shape. With irregular shapes having an average roundness below 0.95 and quite different from a round shape, it is difficult to obtain high quality images of high transfer performance without any dust. Hence, it is preferable that the roundness of the spherical toner be from 0.95 to 1.00.

As for the method of measuring the shape of the spherical toner, for example, the following method can be used. A suspension including particles is passed through a sensing zone of an imaging device on a plate, images of the particles are optically sensed by a CCD camera, and are analyzed. This is referred to as the optical sensing zone method. By this method, it is revealed that a toner particle having an average roundness not less than 0.95 is effective for forming high definition images of appropriate density reproducibility.

Figure 11:
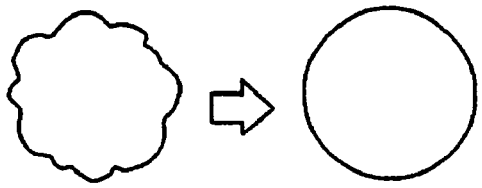
FIG. 11 is a diagram showing the definition of the roundness of a toner particle.

FIG. 11 is a diagram showing the definition of the roundness of a toner particle.

As shown in FIG. 11, the roundness of a toner particle is defined to be a ratio of a circumferential length L2 of a circle which has the same area as a projecting area of the toner particle over a circumferential length L1 of a projecting image of the toner particle.

More preferably, the average roundness of the spherical toner is from 0.960 to 0.998. These values can be measured by using a flow particle image analyzer FPIA-2000 (product name, manufactured by Toa Medical Electronics Co. Ltd).

Specifically, 0.1 to 0.5 ml of a surfactant as a dispersing agent is added to 100 to 150 ml of water held in a container from which water impure solid matter is removed beforehand. Preferably, 0.1 to 0.5 ml of alkylbenzene sulfonate salt is also added to the water. Then, about 0.1 to 0.5 g of a measurement sample is added to the water. Then, a dispersion process is performed on the suspension containing the dispersed sample for about 1 to 3 minutes using an ultrasonic dispersing unit, and the concentration of the dispersed sample solution (suspension) is arranged to be around 3,000 to 10,000/μL to measure the shape and distribution of the toner particles.

The average diameter of the toner particles can be measured in the following way. The average diameter and diameter distribution of the toner particles are obtained by using a Coulter Multisizer III (product name, manufactured by Coulter Electronics Co. Ltd). The Coulter Multisizer III is connected to a personal computer (manufactured by IBM), and data were analyzed by dedicated software (produced by Coulter Electronics Co. Ltd.). The Kd value is set by using 10 μm standard particles. The aperture current is automatically set. The electrolyte is a 1% NaCL water solution prepared by using first grade sodium chloride. In addition to this, ISOTON-II (product name, manufactured by Coulter Scientific Japan Co. Ltd) can also be used.

The measurement is made as below. First, 0.1 to 0.5 ml of a surfactant as a dispersing agent is added to 100 to 150 ml of the above electrolytic water solution. Preferably, 0.1 to 0.5 ml of alkylbenzene sulfonate salt is also added to the electrolytic water solution. Then, about 2 to 20 mg of the measurement sample is added to the electrolytic water solution. Then, a dispersion process is performed on the suspension containing the dispersed sample for about 1 to 3 minutes using an ultrasonic dispersing unit, and by using a 100 μm aperture tube. Then, 50,000 toner particles larger than 2 μm are counted and the diameter of the toner particles averaged on weight of toner particles is measured.

Next, descriptions are made of production methods of the polymerized spherical toner. The spherical toner having a roundness of 0.960 to 0.998 used in the image forming apparatus according to the present embodiment can be produced by, for example, wet granulation methods, such as suspension polymerization, emulsification polymerization, dispersion polymerization, surface polymerization, dissolution and suspension, and phase inversion emulsification. Although it is also possible to produce toners having high roundness by heating treatment on toners obtained by crushing and classification of melting kneading materials, this method is not preferable from the point of view of energy efficiency.

Among the aforesaid wet granulation methods, the suspension polymerization and dispersion polymerization are superior in production stability of toners having high roundness, a sharp distribution of the particle diameter, and toner charging control. The dissolution and suspension is superior in low temperature fusing of toner, and usability of polyester resins.

Below, the suspension polymerization, emulsification polymerization, dispersion polymerization, and dissolution and suspension are described in detail.

<Suspension Polymerization>

For a specific monomer as described below, after a dispersion stabilization agent, coloring agent, and if necessary, a crosslinking agent, a charging control agent, a release agent, and the like are uniformly dispersed by, for example, a ball mill, and a polymerization initiator is added thereto, thereby a monomer phase is obtained. Water dispersion medium phase prepared by agitation with the monomer phase in advance is added to an agitation bath, is agitated by a homogenizer, and after substitution of nitrogen with the obtained suspension, and the heating of the suspension, the polymerization reaction is finished, and colored resin particles are obtained. By cleaning and drying the colored resin particles, toner particles having high roundness can be obtained.

The polymeric monomer used in the suspension polymerization is a monomer with a vinyl group as enumerated below: styrene, o-methyl styrene, m-methyl styrene, p-methyl styrene, 2,4-dimethyl styrene, butyl styrene, octylstyrene, or the like, and derivatives thereof, wherein the styrene monomer is preferable.

The vinyl-based monomer may also include propylene, butylenes, isobutylene, or vinyl halides, such as, vinyl chloride, bromide vinyl, fluoride vinyl; or vinyl esters, such as vinyl acetate, vinyl propionate, vinyl benzoate, vinyl lactate; or alpha-methylene aliphatic monocarbonate esters, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, alpha-chloroacrylate methyl, methyl methacrylate, ethyl methacrylate, n-butyl methacrylate, isobutyl methacrylate, propyl methacrylate, n-octyl methacrylate, dodecyl methacrylate, 2-ethylhexyl methacrylate, stearyl methacrylate, 2-chloroethyl methacrylate, phenyl methacrylate, and diethylaminoethyl methacrylate; or acrylic acid derivatives or methacrylic acid derivatives, such as acrylonitrile, methacrylonitrile, acrylamide; or vinyl-based ethers, such as vinyl methyl ether, vinyl isobutyl ether; or vinyl-based ketones, such as vinylmethyl ketone, vinylhexyl ketone, methyl isobutyl ketone; or N-vinyl compounds such as N-vinyl pyrrol, N-vinyl carbazole, N-vinyl indole, N-vinyl pyrrolidone; or vinyl naphthalene.

These monomers can be used separately or used as a mixture including two or more of them.

In the suspension polymerization, in order to produce cross-linked polymers in monomer components, the following crosslinking agents can be added to perform suspension polymerization. That is, the crosslinking agent may include divinyl benzene, divinyl naphthalene, polyethyleneglycol diacrylate, diethyleneglycol diacrylate, triethyleneglycol diacrylate, 1,3-butyleneglycol diarylate, 1,6-hexaneglycol dimethacrylate, neopentylglycol diacrylate, dipropylene glycol, polypropyleneglycol dimethacrylate, 2,2'-bis(4-acryloxy diethoxyphenyl)propane, 2,2'-bis(4-methacryloxy diethoxyphenyl)propane, trimethylolpropanetrimethacrylate, trimethylolmetanetetraacrylate, dibromoneopentylglycoldimethacrylate, or diaryl phthalate.

If the amount of the used crosslinking agent is too large, it is difficult to melt the toner by heat, resulting in declination of properties of thermal fusing or thermal pressure fusing, and if the amount of the used crosslinking agent is too small, blocking resistance and durability decline, which are required by toners in practical use. In thermal roll fusing, the so-called cold offset occurs, that is, a portion of the toner adheres to the surface of a roller with the portion of the toner not completed fused on a sheet of paper. Therefore, for example, the crosslinking agent amounts to 0.001% to 15% of the polymeric monomers in weight, and preferably, amounts to 0.01% to 10% of the polymeric monomers in weight.

In the suspension polymerization, for example, the dispersion stabilization agent may include water-soluble polymers, such as polyvinyl alcohol, starch, methylcellulose, carboxymethylcellulose, hydroxymethyl cellulose, sodium polyacrylate, sodium polymethacrylate; or barium sulfate, calcium sulfate, barium carbonate, magnesium carbonate, calcium phosphate, talc, clay, diatom earth, and metallic oxide powers. Preferably, the dispersion stabilization agent amounts to 0.1% to 10% of water in weight.

In the suspension polymerization, the polymerization initiating agent may be added into a dispersion solution including the monomer components after granulation, but from the point of view of uniformly assigning the polymerization initiating agent to individual monomer component particles, the polymerization initiating agent may also be included in the monomer components before granulation.

Here, the polymerization initiating agent may be azo-based or diazole-based polymerization initiating agents, such as 2,2'-azobis-(2,4-dimethyl valeronitrile), 2,2'-azobisisobutylonitrile, 1,1'-azobis-(cyclohexane-1-carbonitrile), 2,2'-azobis-4-methoxy-2,4-dimethyl valeronitrile, azobisbutylonitrile; or peroxide-based polymerization initiating agents, such as benzoyl peroxide, methylethylketone peroxide, isopropyl peroxide, 2,4-dichlorylbenzoyl peroxide, lauryl peroxide.

In the suspension polymerization, a magnetic toner, which possesses magnetism, may be used. In order for the toner to have magnetism, it is sufficient to add magnetic particles to the monomer components. In the present embodiment, for example, the magnetic materials may be powders of ferromagnetic metals, such as iron, cobalt, nickel; or powders of alloys or compounds of magnetite, hematite, ferrite or the like.

The diameter of the magnetic particles may be in the range from 0.05 to 5 μm, preferably, from 0.1 to 1 μm, but when forming toners of a small diameter, it is preferable that the diameter of the magnetic particle be less than or equal to 0.8 μm. Preferably, the magnetic particles amount to 10% to 60% of the monomer components in weight.

The magnetic particles may be processed by using surface treatment agents (coupling agents), such as silane coupling agents or titanium coupling agents, or be processed by using appropriate reactive resins. In this processing, when the coupling agent amounts to 5% or less of the magnetic particles in weight, and preferably, amounts to 0.1% to 3% of the magnetic particles in weight, the magnetic particles can be sufficiently dispersed in the monomer components, and there is not any adverse influence on the material properties of the toner.

<Emulsification Polymerization>

Below, the emulsification polymerization for fabricating spherical toner particles is described in detail.

The emulsification polymerization involves aggregating while controlling sub-micron particles to produce particles of sizes appropriate to toner, and is characterized in that the diameter of the toner particle produced by the emulsification polymerization has a very narrow distribution. A method of producing spherical toner particles has long been proposed, which involves spraying and drying latex obtained by the emulsification polymerization, thereby producing perfect spherical toner particles.

<Dispersion Polymerization>

When a polymeric dispersing agent which is soluble in a hydrophilic organic liquid is added to the hydrophilic organic liquid, the polymeric dispersing agent dissolves in the hydrophilic organic liquid. To produce a polymer, one or more types of vinyl monomer, which swells in the hydrophilic organic liquid or is essentially insoluble in the hydrophilic organic liquid, is added to the hydrophilic organic liquid; thereby, a polymerization reaction occurs, and the polymer is produced.

In the above process, a reaction may also be used which allows growth of polymer particles having diameters less than an object diameter set in advance and having a narrow distribution of the particle diameter. The monomers used in the growing reaction may be the same as or different from the monomers used for producing seed particles, as long as it is satisfied that the produced polymer is insoluble in the hydrophilic organic liquid.

Typically, the hydrophilic organic liquid, which acts as a diluting agent of monomers used in producing the above particles or in the growing reaction of the seed particles, may be alcohol-based organic liquids, such as methyl alcohol, ethyl alcohol, modified ethyl alcohol, isopropyl alcohol, n-butyl alcohol, isobutyl alcohol, t-butyl alcohol, s-butyl alcohol, t-amyl alcohol, 3-pentanol, octylalcohol, benzyl alcohol, cyclohexanol, furfuryl alcohol, tetrahydrofurfuryl alcohol, ethylene glycol, glycerin, diethylene glycol; or ether alcohol-based organic liquids, such as metyl cellosolve, cellosolve, isopropyl cellosolve, butyl cellosolve, ethyleneglycol monomethyl ether, diethyleneglycol monomethyl ether.

These hydrophilic organic liquids can be used separately or used as a mixture including two or more of them. Further, if combining the above the alcohol-based and ether alcohol-based organic liquids with other organic liquids than the above alcohol-based and ether alcohol-based organic liquids, as long as the produced polymer particles are insoluble in the organic liquid, by performing polymerization with various SPs (solubility parameters) of the organic liquids, it is possible to control size of the produced particles, and prevent combination of seed particles and prevent production of new particles.

The other organic liquids used in combination with the above alcohol-based and ether alcohol-based organic liquids may be carbon hydride-based organic liquids, such as hexane, octane, petroleum ether, cyclohexane, benzene, toluene, xylene; or halogenated hydrocarbon-based organic liquids, such as carbon tetrachloride, trichloroethylene, tetrabromoethane; or ether-based organic liquids, such as ethyl ether, dimethylglycol, silioxane, tetrahydrofuran; or acetal-based organic liquids, such as methylal, diethylacetal; or ketone-based organic liquids, such as acetone, methyl ethyl ketone, methyl isobutyl ketone, cyclohexane; or ester-based organic liquids, such as butyl formate, butyl acetate, ethyl propionate, cellosolve acetate; or acid-based organic liquids, such as formic acid, acetic acid, propionic acid; or organic compounds including sulfur and nitrogen, such as nitropropene, nitrobenzene, dimethyamine, monoethanol amine, pyridine, dimethyl sulfoxide, dimethylformamide.

In addition, water may also be included in the above organic liquids.

Further, by changing the type and composition of the mixed solvent at the beginning of the polymerization, during the polymerization, and at the end of the polymerization, respectively, it is possible to adjust the average diameter of the produced polymer particles, the distribution of the particle diameter, and drying conditions.

For example, the polymer dispersing agent used in production of the seed particles or the growing polymer particles may be acids, such as acrylic acid, methacrylic acid, alpha-cyanoacrylic acid, alpha-cyanomethacrylic acid, itaconic acid, crotonic acid, fumaric acid, maleic acid; or maleic anhydride; or acryl-based monomers including a hydroxyl group, such as beta-hydroxyethyl acrylate, beta-hydroxyethyl methacrylate, gamma-hydroxyethyl acrylate, gamma-hydroxyethyl methacrylate, 3-chloro-2-hydroxypropyl acrylate, 3-chloro-2-hydroxypropyl methacrylate, ester from diethylene glycol and monoacrylic acid, ester from diethylene glycol and monomethacrylic acid, ester from glycerin and monoarylic acid, ester from glycerin and monometharylic acid, N-methylolacrylamide, N-methylolmethacrylamide; or vinyl alcohols or esters with vinyl alcohols, such as vinyl methyl ether, vinyl ethyl ether, vinyl propyl ether; or ethers with compounds including vinyl alcohol and a carboxyl group, such as vinyl acetate, vinyl propionate, vinyl lactate, acrylamide, methacrylamide, diacetone acrylamide; or the compounds of the above materials with methylo; or acryloyl chloride, methacryloyl chloride; or homopolymers or co-polymers of heterocycle compounds having nitrogen atoms, such as vinyl pyridine, vinyl pyrrolidone, vinyl imidazol, ethyleneimine; or the polyoxyethylene family, such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester; or celluloses, such as hydroxyethylcellulose, hydroxypropylcellulose, methyl cellulose; or those including the aforesaid hydrophilic monomer and benzene nucleus like styrene, alpha-methyl styrene, vinyltoluene, or the derivatives of them; or copolymers with acrylic acid like acrylonitrile, methacrylonitrile, acrylamide; or copolymers with methacrylic acid; or copolymers with crosslinking monomers like ethyleneglycol dimethacrylate, diethyleneglycol dimethacrylate, aryl methacrylate, divinyl benzene.

These polymer dispersing agents can be appropriately selected according to the hydrophilic organic liquid to be used, desired type of the polymeric particles, and purpose of the polymer dispersing agents, that is, for producing seed particles or growing particles. From the point of view of primarily sterically preventing combination of polymer particles, it is preferable to select polymer dispersing agents having high capillarity and adsorption with the surface of the polymer particles, and high capillarity with and solubility in the hydrophilic organic liquid. In addition, in order to increase repulsion between particles sterically, polymer dispersing agents having long molecular chains may be selected, preferably, polymer dispersing agents having molecular weights greater than 10,000 are selected. Nevertheless, if the molecular weight is too large, the liquid viscosity increases significantly, hence, operation and agitation become difficult, and this may result in fluctuation in probability of precipitation on the surface of the produced polymer. It is also effective for stabilization to make a portion of the monomers of the above polymer dispersing agents to co-exist with monomers constituting the object polymer particles.

It is possible to further improve stability of the produced polymer particles and the particle diameter distribution by using the polymer dispersing agent with metals or metallic alloys (preferably, the particle diameter is less than 1 μm), such as, cobalt, iron, nickel, aluminum, copper, tin, lead, magnesium; or fine powders of inorganic compounds including oxides, such as iron oxide, copper oxide, nickel oxide, zinc oxide, titanium oxide, silicon oxide; or negative ion surfactants such as higher alcohol sulfuric acid ester sodium salt, alkylbenzene sulfonate, alpha-olefinsulfonate salt, phosphate ester; or amine salts such as alkylamine salt, aminoalcohol fatty acid derivative, polyamine fatty acid derivative, imidazoline; or quaternary ammonium salt positive ion surfactants, such as alkyltrimethylammonium salt, dialkyldimethylammonium salt, alkyldimethylbenzylammonium salt, pyridinium salt, alkylisoquinolinium salt, benzethonium chloride; or non-ion surfactant such as fatty amide derivative, multivalent alcohol derivative; or alanine amino-acid amphoteric surfactants, such as dodecyl (aminoethyl) glycine, di(octylaminoethyl)glycine; or betaine amphoteric surfactants.

In general, the amount of the polymer dispersing agent used for producing seed particles depends on the type of the polymeric monomer used for forming the desired polymer particles, and usually the polymer dispersing agent amounts to 0.1% to 10%, and preferably, 1% to 5% of the hydrophilic organic liquid in weight. If the concentration of the polymer dispersion stability agent is low, the produced polymer particles have relatively large diameters, and if the concentration of the polymer dispersion stability agent is high, the produced polymer particles have relatively small diameters. Nevertheless, If the concentration of the polymer dispersion stability agent exceeds 10% in weight, the effect of reducing particle diameters is small.

The aforesaid vinyl monomer is soluble in the hydrophilic organic liquid, for example, it may be one of, or a mixture of any of styrene monomers such as styrene, o-methyl styrene, m-methyl styrene, p-methyl styrene, alpha-methyl styrene, p-ethyl styrene, 2,4-dimethyl styrene, p-n-butyl styrene, p-tert-butyl styrene, p-n-hexyl styrene, p-n-octyl-styrene, p-n-nonyl styrene, p-n-decyl styrene, p-n-dodecyl styrene, p-methoxy styrene, p-phenylstyrene, p-chlorostyrene, 3,4-dichlorostyrene; or alpha-methylene aliphatic monocarbonate esters, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, alpha-chloroacrylate methyl, methyl methacrylate, ethyl methacrylate, n-butyl methacrylate, isobutyl methacrylate, propyl methacrylate, n-octyl methacrylate, dodecyl methacrylate, 2-ethylhexyl methacrylate, stearyl methacrylate, 2-chloroethyl methacrylate, phenyl methacrylate, diethylaminoethyl methacrylate; or acrylic acid derivatives or methacrylic acid derivatives, such as acrylonitrile, methacrylonitrile, acrylamide; or vinyl halides, such as vinyl chloride, vinylidene chloride, bromide vinyl, fluoride vinyl.

In addition, the vinyl monomer may also be a mixture of any of the above materials with monomers able to be polymerized with the above materials, with the concentration of the above materials being above 50% in the mixture.

In order to increase an offset resistance of the above polymers, polymerization may be carried out with a crosslinking agent, which has two polymerization double-bonds being present.

Preferable the crosslinking agent may be aromatic divinyl compounds such as divinyl benzene, divinyl naphthalene, and their derivatives; or diethylenic carbonic acid esters such as ethyleneglycol dimethacrylate, diethyleneglycol dimethacrylate, diethyleneglycol methacrylate, triethyleneglycol methacrylate, trimethylolpropanetriacrylate, aryl methacrylate, tert-butylaminoethyl methacrylate, tetraethyleneglycol dimethacrylate, 1,3-butanediol dimethacrylate; or all kinds of divinyl compounds such as N,N-divinyl aniline, divinyl ether, divinyl sulfide, divinyl sulfone; or compounds having three or more vinyl groups.

The above materials can be used separately or used as a mixture including two or more of them.

When the polymerization reaction for growth is performed using the cross-linked seed particles, inside a grown polymer particle, cross-linking occurs. When the above crosslinking agent is included in the vinyl monomer solution used in the growing reaction, a polymer is obtained in which the particle surface is hardened.

In order to adjust the average molecular weight, for example, low molecular compounds having mercapto-groups, carbon tetrachloride, or carbon tetrabromide may be coexistent with compounds having large chain transfer constants.

Here, the polymerization initiating agent monomer may be combinations of sodium hyposulfite or amine with azo-based polymerization initiating agents, such as 2,2'-azobis-(2,4-dimethyl valeronitrile), 2,2'-azobisisobutylonitrile; or peroxide-based polymerization initiating agents, such as benzoyl peroxide, lauryl peroxide, t-butyl peroctoate; or persulfuric acid-based polymerization initiating agents, such as potassium persulfate.

The concentration of the polymerization initiating agent, preferably, amounts to 0.1% to 10% of the vinyl monomer in weight.

The conditions of the polymerization reaction for producing the seed particles are determined by the object average diameter of the polymerization particles, the object distribution of the diameter of the polymerization particles, and by the concentration of the polymer dispersing agent in the hydrophilic organic liquid, the concentration of the vinyl monomers, and the composition ratio. In general, if it is desired to reduce the average diameter of the polymerization particles, it is necessary to increase the concentration of the polymer dispersing agent in the hydrophilic organic liquid, and if it is desired to increase the average diameter of the polymerization particles, it is necessary to decrease the concentration of the polymer dispersing agent in the hydrophilic organic liquid. Further, if it is desired to obtain a sharp distribution of the diameter of the polymerization particles, it is necessary to decrease the concentration of the vinyl monomer, and if it is desired to obtain a relatively broad distribution of the diameter of the polymerization particles, it is necessary to increase the concentration of the vinyl monomer.

The polymerization particles are produced in the following way. After a polymer dispersion stabilization agent dissolves completely in the hydrophilic organic liquid, one or more types of vinyl monomer, polymerization initiating agent, and when necessary, inorganic fine powders, surfactants, dyestuff, and pigments are added into the hydrophilic organic liquid, and the thus obtained hydrophilic organic liquid is agitated at a usual agitation speed of 30 to 300 rpm, preferably, as low as possible, by using a paddle type agitator rather than turbine type agitator. The hydrophilic organic liquid is heated at a temperature corresponding to a polymerization speed of the polymerization initiating agent, while being agitated at a speed ensuring the flow of the liquid in the bath is uniform, and under these conditions, the polymerization reaction takes place.

Because the temperature at the beginning of the polymerization reaction strongly influences the seed particles to be produced, it is preferable that the temperature of the liquid in the bath be raised to the polymerization temperature after the monomer is added, and the polymerization initiating agent be first dissolved in a small quantity of solvent before being introduced. Before carrying out the polymerization reaction, it is necessary to sufficiently purge oxygen from the reaction vessel by using inert gases, such as argon gas. If oxygen is not purged sufficiently, fine particles may be produced easily. Usually, 5 to 40 hours are required to complete the polymerization process in a high polymerization rate region, but it is possible to raise the polymerization speed by carrying out the polymerization reaction at a high pressure, and stopping the polymerization process when the desired particle diameter and the distribution thereof are obtained, or introducing the polymerization initiating agent sequentially.

After the polymerization process, slurry may be used directly in the dyeing process; alternatively, the liquid may also be recovered as polymeric slurry to perform the dyeing process after unnecessary fine particles, residual monomers, polymer dispersion stabilization agents and so on are eliminated by sedimentation, centrifugal separation, and decantation. When the polymer dispersion stabilization agents are not eliminated, the dyeing stability can be raised, and this prevents unnecessary aggregation.

The dyeing process in the dispersion polymerization is described below. Resin particles are dispersed in an organic solvent in which the resin particles are insoluble, and before that or after that, dyestuff is dissolved in the solvent. After the dyestuff infiltrates into the resin particles and the resin particles are colored, the organic solvent is removed, obtaining the dyeing toner. In the method of producing the dyeing toner, such dyestuffs can be selected that $(D1/D2) \leqq 0.5$, where, D1 represents the solubility of the dyestuff with respect to the organic solvent, and D2 represents the solubility of the dyestuff with respect to the resin particles A. By this selection, it is possible to efficiently produce toner after the dyestuff infiltrates (diffuses) into the resin particles deeply.

Here, it is assumed that the solubility measured at a temperature of 25° C. is used.

In the above, the solubility of the dyestuff with respect to the resin is defined in the same way as the solubility of the dyestuff with respect to the solvent, and represents a maximum possible inclusion of the dyestuff in the resin under a compatible state. The dissolution state or deposition state of the dyestuff can be observed easily by using a microscope.

The solubility of the dyestuff with respect to the resin may also be found by indirect observation instead of the above direct observation. Specifically, using a liquid having a solubility coefficient similar to that of the resin, that is, using a solvent in which the resin is highly soluble, the solubility of the dyestuff in the solvent can be regarded as the solubility of the dyestuff in the resin.

As described above, it is required that the dyestuff used for coloring satisfy that the ratio of the solubility D1 of the dyestuff with respect to the organic solvent to the solubility D2 of the dyestuff with respect to the resin particles is less than or equal to 0.5 ($(D1/D2) \leqq 0.5$), and preferably, $(D1/D2) \leqq 0.2$. Any dyestuff can be used as long as the relation of D1 and D2 is satisfied. However, properties of water soluble dyes, such as a cationic dye, an anionic dye, and the like, may change significantly along with the environment, and toners obtained using these dyestuffs may have low electrical resistances, thereby resulting in a low transfer rate. Therefore, it is preferable to use a vat dye, a dispersion dye, or an oil-soluble dye, and more preferably, the oil-soluble dye. Depending on the desired color tone, plural dyestuffs can be used in combination.

The ratio (in weight) of the dyestuff to be used for coloring and the resin particles can be selected as desired according to the desired color. Usually, it is preferable to set the weight of the dyestuff to be 1 to 50 units when the weight of the resin particles is 1 unit. For example, alcohols such as methanol, ethanol of high SPs (solubility parameters) may be used as the dyeing solvent. When styrene-acryl-based resins having SPs near 9 are used as the resin particles, the dyestuff can be any one of C.I. SOLVENT YELLOW (6,9,17,31,35,1,102,103,105),
C.I. SOLVENT ORANGE (2,7,13,14,66),
C.I. SOLVENT RED (5,16,17,18,19,22,23,143,145,146, 149,150,151,157,158),
C.I. SOLVENT VIOLET (31,32,33,37),
C.I. SOLVENT BLUE (22,63,78,83~86,91,94,95,104),
C.I. SOLVENT GREEN (24,25),
C.I. SOLVENT BROWN (3,9), and so on.

Among commercial dyes, for example, the following dyes can be used. That is, dyes Aisen SOT produced by Hodogaya Chemistry Co. Ltd, such as Yellow-1,3,4, Orange-1,2,3, Scarlet-1, Red-1,2,3, Brown-2, Blue-1,2, Violet-1, Green-1, 2,3, Black-1,4,6,8; or dyes SUDAN produced by BASF Co., such as Yellow-140,150, Orange-220, Red-290,380,460, Blue-670; or dyes produced by Mitsubishi Kasei Co., such as Yellow-3G,F,H2G,HG,HC,HL, Orange-HS,G, Red-GG, S,HS,A,K,H5B, Violet-D, Blue-J,G,N,K,P,H3G,4G, Green-C, Brown-A; dyes OIL colors produced by Orient Chemical Industries, Ltd., such as Yellow-3G, GG-S, #105, Orange-PS, PR, #201, Scarlet-#308, Red-5B, Brown-GR, #416, Green-BG, #502, Blue-BOS, HN, Black-HBB, #803, EE, EX; dyes sumiplast produced by Sumitomo Chemical Industries, Co., such as Blue GP, OR, Red FB, 3B, Yellow FL7G, GC; dyes produced by Nippon Kayaku Co., Ltd, such as KAYALON, polyester BLACK EX-SH3, KAYASET Red-B Blue-A-2R.

It is certain that the dyestuff is not limited to the above examples, but can be appropriately selected while considering the combination of the resin particles and the solvent used in coloring.

The dyeing organic solvent used for adhesion of the dyestuff to the resin particles is insoluble in the resin particles, or swells more or less. For example, the difference of the solubility parameter of the dyeing organic solvent is greater than 1.0, and preferably, greater than 2.0. For example, for styrene-acryl-based resin particles, use can be made of alcohols, such as methanol, ethanol, n-propanol having large solubility parameters, and n-hexane, n-heptan having small solubility parameters. If the difference of the solubility parameter is too large, the wetting effect on the resin particles becomes insufficient, and good dispersion of the resin particles cannot be obtained. Hence, it is preferable that the solubility parameter be in the range from 2 to 5.

After the resin particles are dispersed in the organic solvent, in which the dyestuff is dissolved, it is preferable that the solution be agitated with the temperature of the liquid being maintained to be lower than the glass transition temperature of the resin particles. Due to this, it is possible to dye the resin particles while ensuring that the resin particles do not aggregate.

Agitation can be performed using commercial agitating devices, such as a homomixer, a magnetic stirrer.

In the suspension polymerization, after the polymerization process, the dyestuff can be directly added in the slurry obtained after the polymerization process, which is a dispersing liquid obtained by dispersing the polymer resin particles in the organic solvent, and the slurry can be heated and agitated under the aforesaid conditions.

If the heating temperature exceeds the glass transition temperature of the resin particles, the resin particles begin to fuse with each other.

The dyed slurry can be dried by any method available, and there is not any limit to the drying method. For example, the slurry may be first filtered, and then dried at a reduced pressure, or dried at a reduced pressure without being filtered.

In the present embodiment, the colored particles obtained by low pressure drying or air-drying after filtering substantially did not aggregate, and the granular distribution of the introduced resin particles was reproduced with little impairment.

Next, as described above, when ET developing is performed with the toner electrostatic transportation unit 12, it is required that stably charged toner be supplied to the toner electrostatic transportation unit 12. Especially, in recent image forming apparatuses, along with increase of the printing speed and duplicating speed, toner consumption in a unit time increases. Accordingly, in addition to rapid refilling of the electrostatic transportation unit 12 with toner, it is also required that the developing agent be mixed and agitated rapidly so as to increase the amount of charge carried by the toner to a level suitable for developing in a short time. The agitation transportation device of the related art, which has screw-shaped vanes, cannot meet this requirement.

In the image forming apparatus according to the present embodiment, the agitating and transportation screw 27 is installed in the agitation bath 23, and the mesh electrode 28 is installed between the agitating and transportation screw 27 and the toner electrostatic transportation unit 12. Due to this, it is possible to mix and agitate the developing agent rapidly, accumulate a charge on the toner to a level suitable for developing in a short time, and rapidly resupply the toner.

Specifically, as illustrated in FIG. 8, in the developing vessel 21, the spiral screw agitating and transportation screw 27 has a screw member with a main axis of 6 mm, a length of 230 mm, and a 175 mm long screw portion, which is formed by injecting a fused resin including an ABS resin added with 30% glass fiber and a PC resin, the spiral screw portion 32 is formed on the circumferential surface of the main axis 31, and inorganic fine particles 33 able to charge the toner T are formed on the surface of the main axis 31. For example, the inorganic fine particles 33 are formed by fabricating a film using barium titanate glass powders (average particle diameter: 5 μm)) by means of high speed injection.

The agitating and transportation screw 27 was rotated at a rotational speed of 60 mm/sec, and polymerized toners having an average particle diameter of 7 μm were delivered from the 5 mm×100 mm mesh electrode area, which acts as a toner delivery area. Pattern of the toner was observed by bare eyes, and it was found that there was toner uniformity.

In this way, when developing the latent images on the image carrier 1 by using a two-composition developing agent including a toner T and a carrier C, because a rotating agitation unit for agitating the developing agent, the toner electrostatic transportation unit for transporting the toner T supplied from the toner supplier 11 to a developing region of the image carrier 1 by a traveling wave electric field, and a mesh electrode arranged between the agitation unit and the toner electrostatic transportation unit are provided, it is possible to obtain an electrostatic developing device superior in agitation and transportation performance.

Because the screw member is used as a agitation unit, the structure of is simple. Because charging materials are formed on the screw member, it is possible to efficiently agitate and charge.

Instead of the screw member, a fur brush may also be used. For example, the fur brush may be formed by winding an insulating fiber (brush) on a SUS core, and, for example, the insulating fiber may be a nylon fiber having a diameter from 0.1 to 1 μm, a winding density of 40,000 to 200,000, a pile length of 1-15 mm. It is preferable that the fur brush be arranged so that the end of the brush is in contact with the mesh electrode 28.

In this structure, in the toner hopper portion 22 of the developing vessel 21, the carrier C and the refilled toner T are mixed and agitated by the agitator 26, and are fed to the agitation bath 23. Because the toner T is in contact with the fur brush, the toner T is charged with charge selected by the fur brush (negative), and the toner T is carried on the surface of the fur brush or between the fibers of the fur brush due to an adhesive force like an image force. Along with the rotation of the fur brush, the toner T arrives at the mesh electrode 28, and is separated from the fur brush by an electric field. Because of a mechanical scraping force, the toner T absorbed by an electrostatic force can be easily separated from the fur brush. In this way, when the fur brush is used, the toner can be supplied easily, and this also prevents clogging of the mesh.

Figure 12:
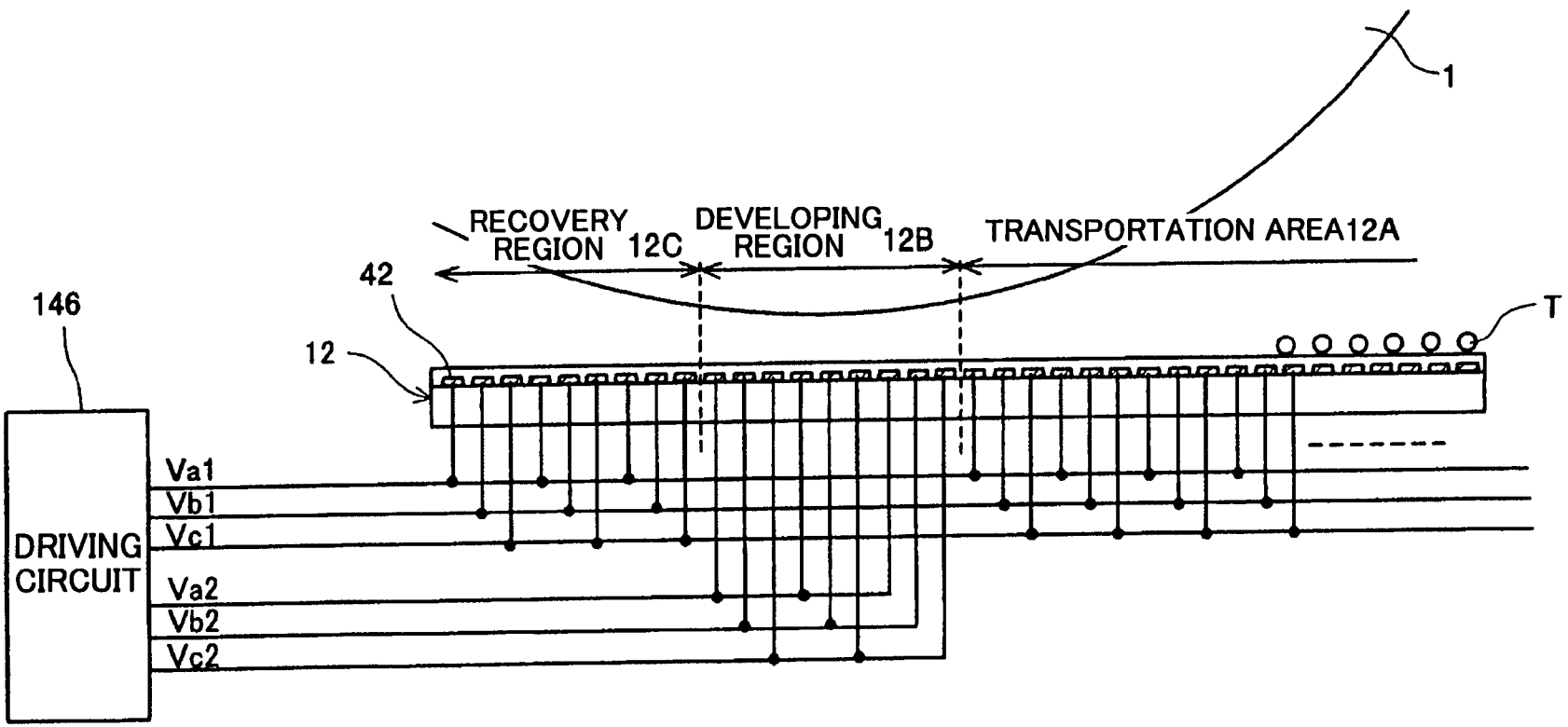
FIG. 12 is a diagram showing another example of the developing device of the present embodiment.

FIG. 12 is a diagram showing another example of the developing device of the present embodiment. In FIG. 12, the same reference numbers are assigned to the same elements as those shown in the previous figures.

As illustrated in FIG. 12, the toner electrostatic transportation unit 12 is divided into three areas according to the region of the electrodes 42, which receive driving voltages Va1, Vb1, and Vc1, and Va2, Vb2, and Vc2 from a driving circuit 146, and according to relations with the image carrier 1, there is a transportation area 12A where the toner T is transported near the image carrier 1, a developing region 12B where the toner T is attached to the latent images on the image carrier 1 to form toner images, and a recovery region 12C next to the developing region 12B, where the toner T is recovered in the toner electrostatic transportation unit 12.

In the transportation area 12A of the toner electrostatic transportation unit 12, the toner electrostatic transportation unit 12 transports the toner T near the image carrier 1.

In the developing region 12B, the toner T is applied on the latent images on the image carrier 1 to form toner images, the toner electrostatic transportation unit 12 generates an electric field between the image carrier 1 and the toner electrostatic transportation unit 12, the electric field directs the toner T toward the image portion of the latent image of the image carrier 1, and directs the toner T away from the non-image portion of the latent image on the image carrier 1, that is, directs the toner T in a direction to the toner electrostatic transportation unit 12, thus attaching the toner to the latent image to develop the latent image. Here, the non-image portion of the latent image is the portion of the latent image that is not to be developed into an image.

In the recovery region 12C, the toner electrostatic transportation unit 12 generates an electric field which urges the toner T in the image portion and the non-image portion of the latent image to move toward the toner electrostatic transportation unit 12, that is, away from the image carrier 1.

Because of such a configuration, in the developing region 12B, the toner T is applied on the latent images on the image carrier 1, and the latent images become visible toner images. The toner T not contributing to developing is recovered by the toner electrostatic transportation unit 12 in the recovery region 12C on the downstream side along the rotation direction (moving direction) of the image carrier 1, thus preventing scattering of the toner T.

The driving circuit 146 applies driving voltages on the toner electrostatic transportation unit 12.

Figure 13:
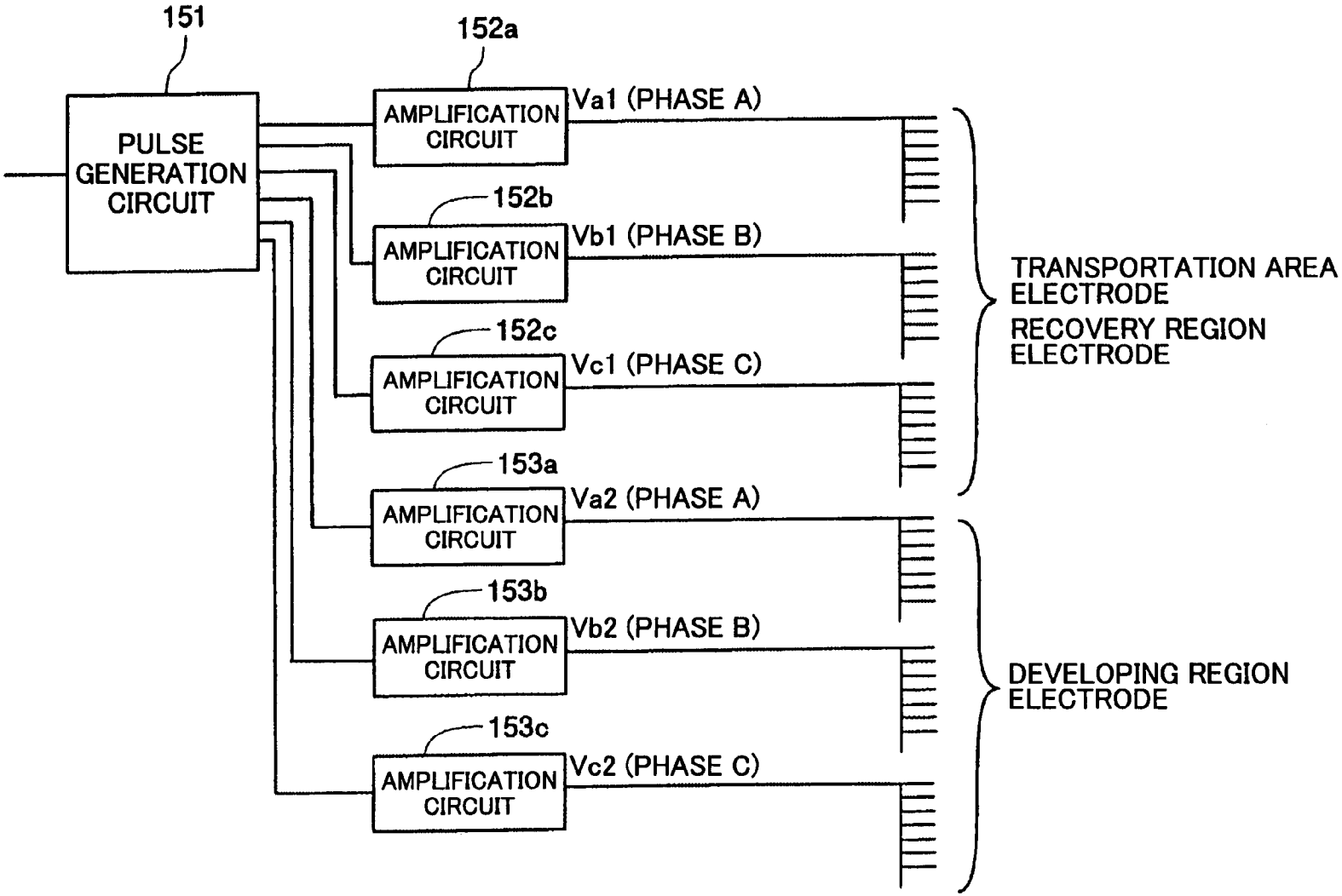
FIG. 13 is a circuit diagram showing a configuration of the driving circuit 146.

FIG. 13 is a circuit diagram showing a configuration of the driving circuit 146.

As illustrated in FIG. 13, the driving circuit 146 includes a pulse generation circuit 151 for generating pulsed signals, amplification circuits 152*a*, 152*b*, 152*c*, which receive the pulsed signals from the pulse generation circuit 151 and generate driving voltages Va1, Vb1, and Vc1, and amplification circuits 153*a*, 153*b*, 153*c*, which receive the pulsed signals from the pulse generation circuit 151 and generate driving voltages Va2, Vb2, and Vc2, respectively.

For example, the pulse generation circuit 151 receives logic level input pulses, and drives switches (for example, transistors) included in the amplification circuits 152*a*, 152*b*, 152*c* and 153*a*, 153*b*, 153*c* at the next stage with two groups of pulses each of which is phase-shifted by 120 degrees to generate 10 to 15 volts pulsed signals, which are able to drive switching operation at 100 V.

Figures 14A, 14B, 14C:
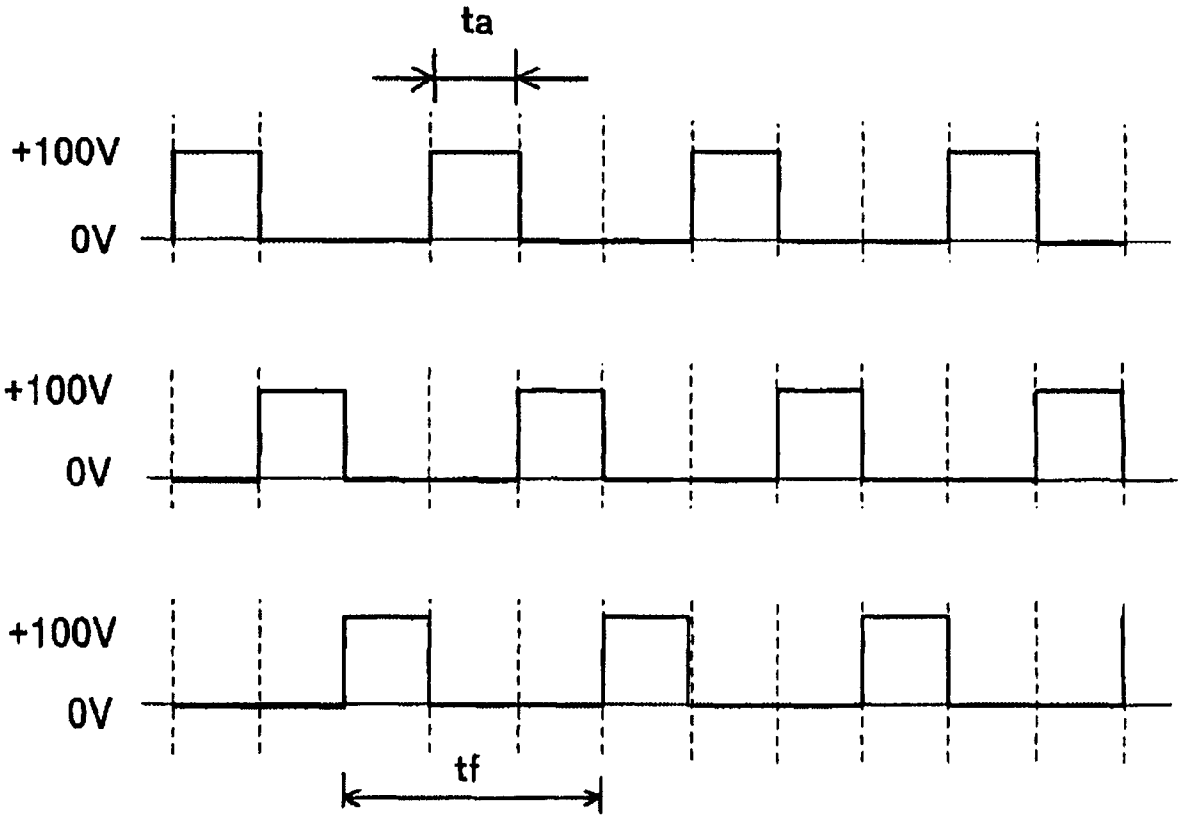
FIGS. 14A through 14C are waveforms of the driving voltages Va1, Vb1, and Vc1, applied on the toner electrostatic transportation unit 12.

The amplification circuits 152*a*, 152*b*, 152*c*, for example, apply three-phase driving voltages Va1, Vb1, and Vc1, as illustrated in FIGS. 14A through 14C, to the electrodes 42 in the transportation area 12A, and the electrodes 42 in the recovery region 12C.

FIGS. 14A through 14C are waveforms of the driving voltages Va1, Vb1, and Vc1, applied on the toner electrostatic transportation unit 12.

As illustrated in FIGS. 14A through 14C, the application time ta of +100 V for each phase is equal to ⅓ of the cycle Tf of the driving voltages Va1, Vb1, and Vc1. The waveforms shown in FIGS. 14A through 14C are referred to as "transportation voltage pattern", and "recovery voltage pattern".

The amplification circuits 153*a*, 153*b*, 153*c*, for example, apply three-phase driving voltages Va2, Vb2, and Vc2, as illustrated in FIGS. 15A through 15C or FIGS. 16A through 16C, to the electrodes 42 in the developing area 12B.

Figures 15A, 15B, 15C:
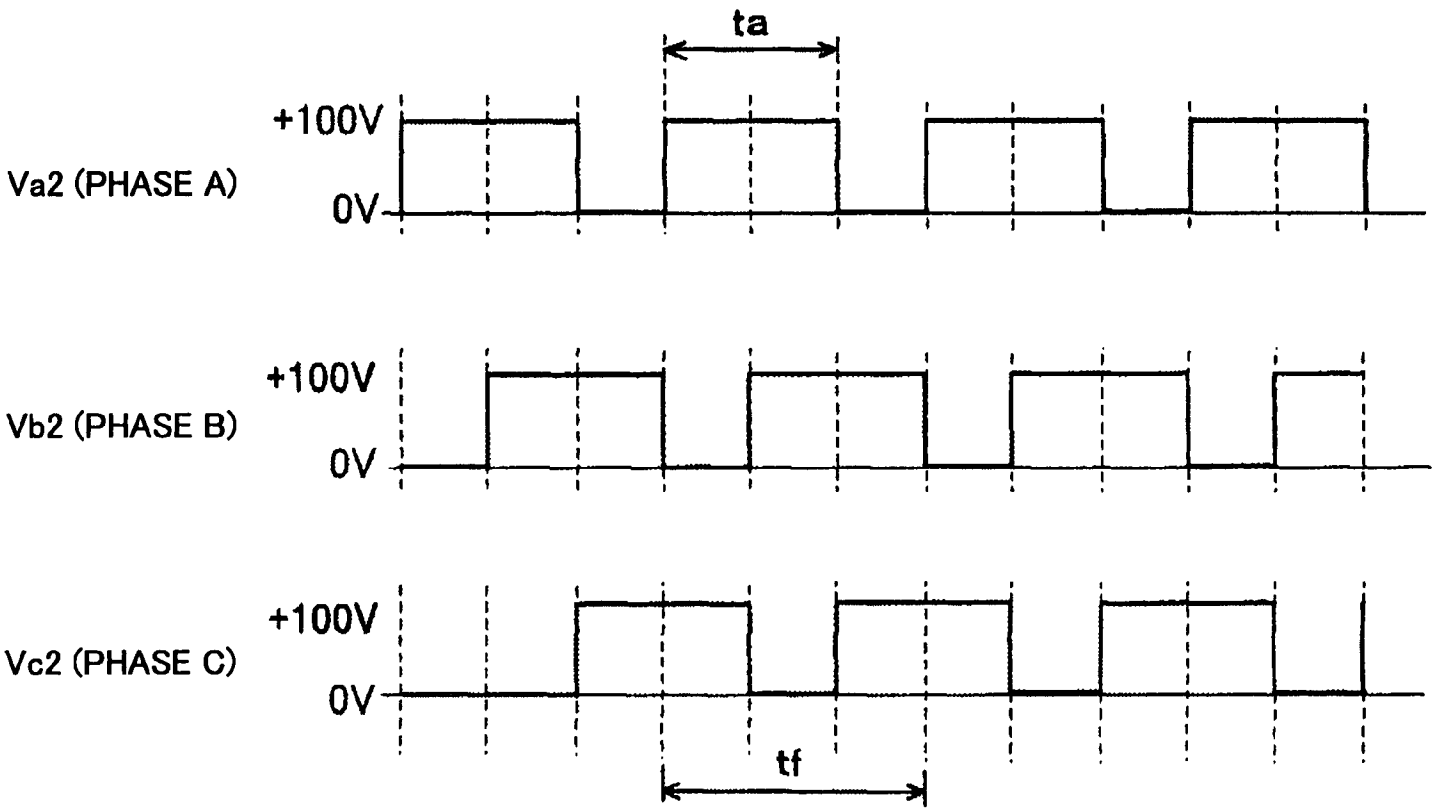
FIGS. 15A through 15C show an example of waveforms of the driving voltages Va2, Vb2, and Vc2, applied on the toner electrostatic transportation unit 12.

FIGS. 15A through 15C show an example of waveforms of the driving voltages Va2, Vb2, and Vc2, applied on the toner electrostatic transportation unit 12.

As illustrated in FIGS. 15A through 15C, the application time ta of +100 V of each phase is set to be ⅔ of the cycle Tf of the driving voltages Va2, Vb2, and Vc2.

Figures 16A, 16B, 16C:
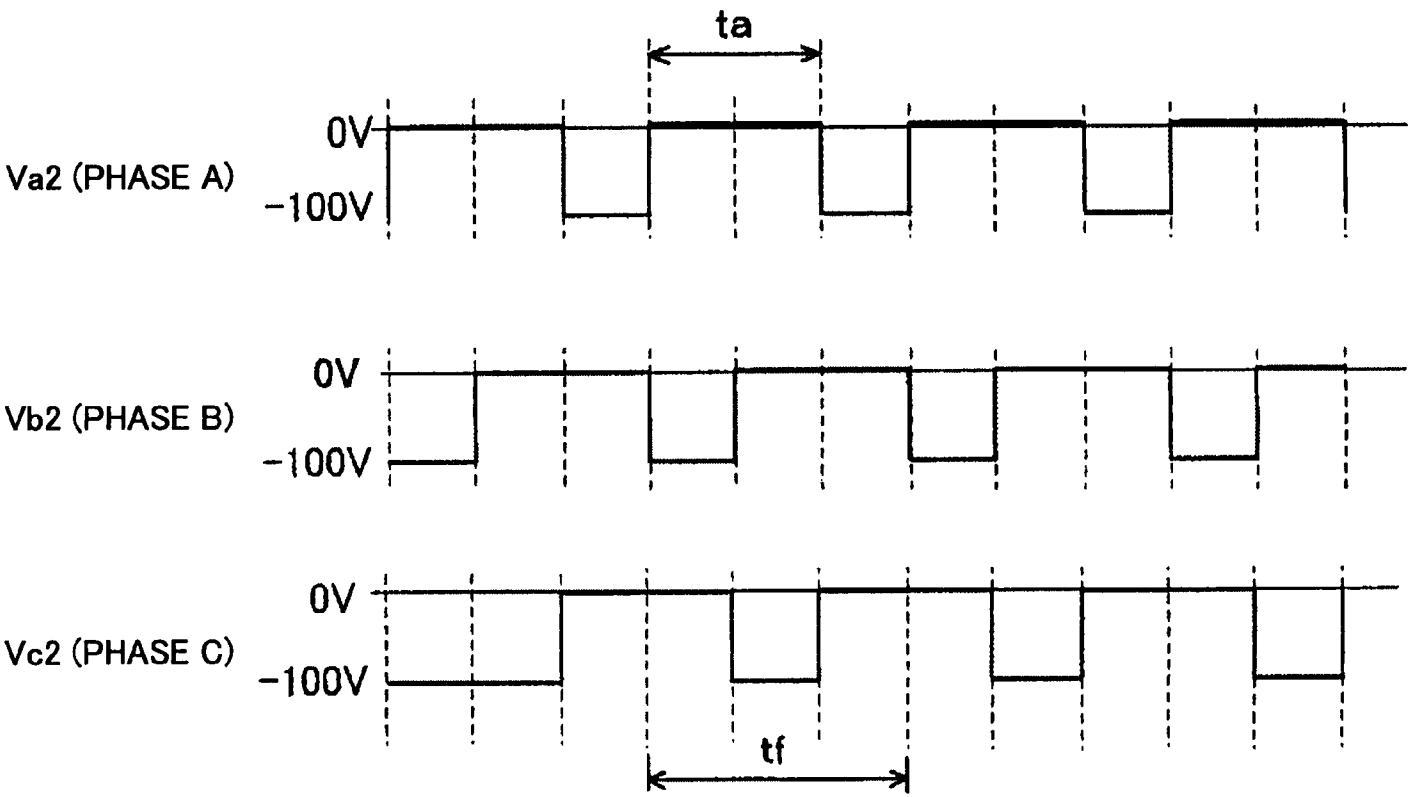
FIGS. 16A through 16C show another example of waveforms of the driving voltages Va2, Vb2, and Vc2, applied on the toner electrostatic transportation unit 12.

FIGS. 16A through 16C show another example of waveforms of the driving voltages Va2, Vb2, and Vc2, applied on the toner electrostatic transportation unit 12.

As illustrated in FIGS. 16A through 16C, the application time ta of 0V of each phase is set to be ⅔ of the cycle Tf of the driving voltages Va2, Vb2, and Vc2. The waveforms shown in FIGS. 15A through 15C and FIGS. 16A through 16C are referred to as "hopping voltage pattern".

Especially, in ET developing, toner is transported by electrostatic transportation, but, different from the developing device of the related art using the electrostatic transportation, instead of using smoking or clouding of toner for developing, which spontaneously occurs along with the electrostatic transportation, the toner is launched toward the image carrier for developing.

Experiment results so far reveal that the waveforms of the driving voltages Va2, Vb2, and Vc2 shown in FIGS. 15A through 15C, and FIGS. 16A through 16C, that is, the hopping voltage pattern, are suitable for launching the toner onto the electrodes 42 upright, specifically, the application time ta of +100 V or 0 V is set to be ⅔ (67%) of the cycle Tf of the driving voltages Va2, Vb2, and Vc2.

In addition, the waveforms of the driving voltages Va1, Vb1, and Vc1 shown in FIGS. 14A through 14C, that is, the transportation voltage pattern, are suitable for transporting the toner, specifically, the application time ta of +100 V is set to be ⅓ (33%) of the cycle Tf of the driving voltages Va1, Vb1, and Vc1.

Here, when the driving waveform of the hopping driving voltage pattern is a pulsed voltage waveform as shown in FIGS. 16A through 16C, which changes from a level of 0 V to a level of −100 V, and if the voltage of the non-image portion on the image carrier 1 is lower than −100 V, with respect to the image portion of the latent image, the toner T is directed toward the image carrier 1, and with respect to the non-image portion of the latent image, the toner T is directed toward the toner electrostatic transportation unit 12, that is, the toner T is directed away from the image carrier 1. With these settings, it was confirmed that when the voltage of the non-image portion on the image carrier 1 was set to be −150 V or −170 V, the toner T was directed toward the image carrier 1 with respect to the non-image portion of the latent image.

Even when the driving waveform of the hopping driving voltage pattern is a pulsed voltage waveform changing from 20 V to −80 V, if the voltage of the image portion is 0 V, the voltage of the non-image portion is −110 V, because the low level of the pulsed driving waveform is between the voltage of the image portion and the voltage of the non-image portion. Similarly, with respect to the image portion, the toner T is directed toward the image carrier 1, and with respect to the non-image portion, the toner T is directed away from the image carrier 1.

In other words, by setting the low level of the pulsed driving waveform to be between the voltage of the image portion and the voltage of the non-image portion, adhesion of the toner to the non-image portion is preventable, enabling high quality developing.

Figure 17:
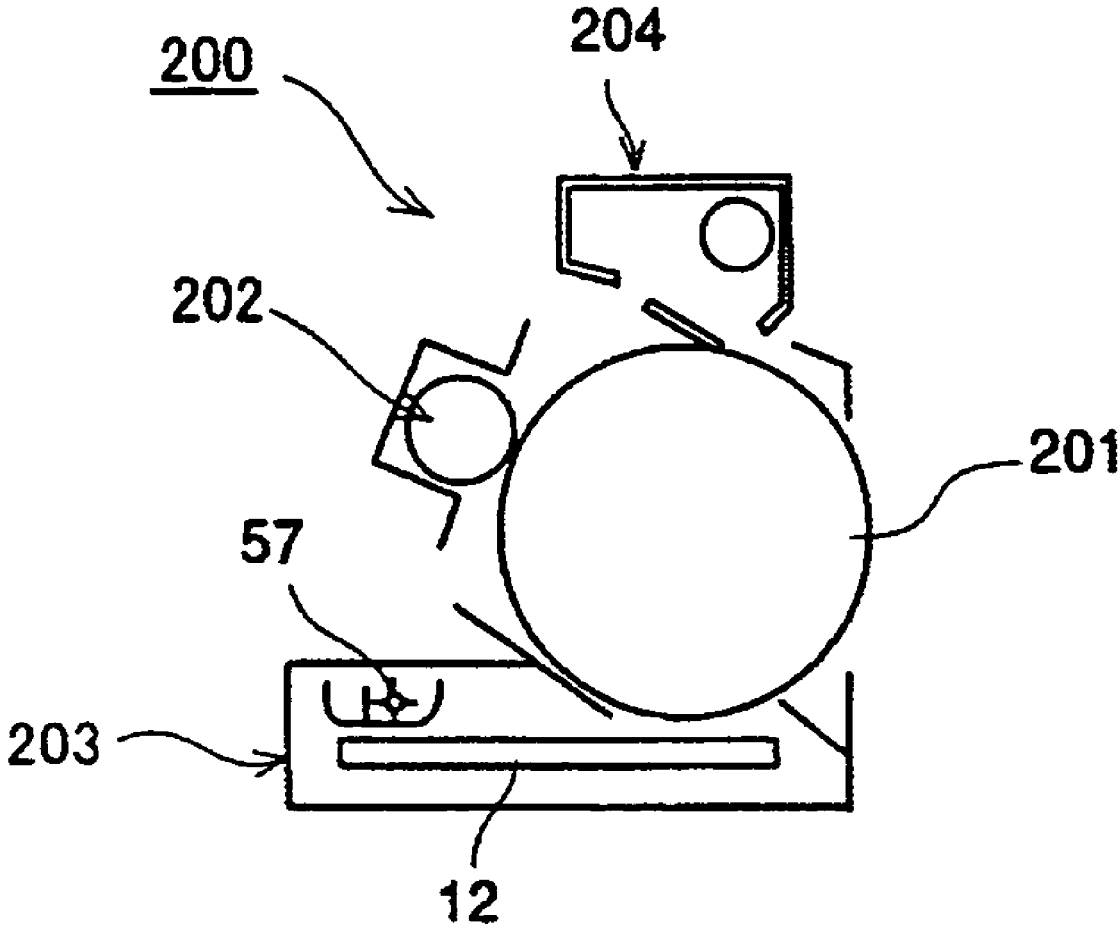
FIG. 17 is a schematic view showing a process cartridge according to the present embodiment.

FIG. 17 is a schematic view showing a process cartridge according to the present embodiment.

As illustrated in FIG. 17, the process cartridge 200 includes an image carrier 201, a charging unit 202, an electrostatic developing unit 203, and a cleaning unit 204.

It should be noted that the process cartridge 200 at least include the electrostatic developing unit 203, and may further include one or more of the other units, that is, the image carrier 201, the charging unit 202, and the cleaning unit 204. These components are integrated together, and forming the process cartridge 200. The process cartridge 200 is detachably attached to an image forming apparatus, such as a copier or a printer.

Usually, a color image forming apparatus has plural image forming units; due to this, the size of the apparatus is large. In addition, if any of the developing unit, the cleaning unit, or the charging unit is in trouble, or any component needs to be exchanged due to expiration of service life, because the apparatus is complicated, exchange of any component is time consuming.

According to the present embodiment, by integrating plural components including at least the developing unit together to form the process cartridge 200, it is possible to form a compact and durable color image forming apparatus enabling component exchange by users.

Further, in the process cartridge 200, by providing a device (as exemplified in FIG. 5 and FIG. 6) for applying a material capable of reducing the surface friction coefficient of the image carrier 201, the structure for maintaining the surface friction coefficient of the image carrier 201 is simplified.

Figure 18:
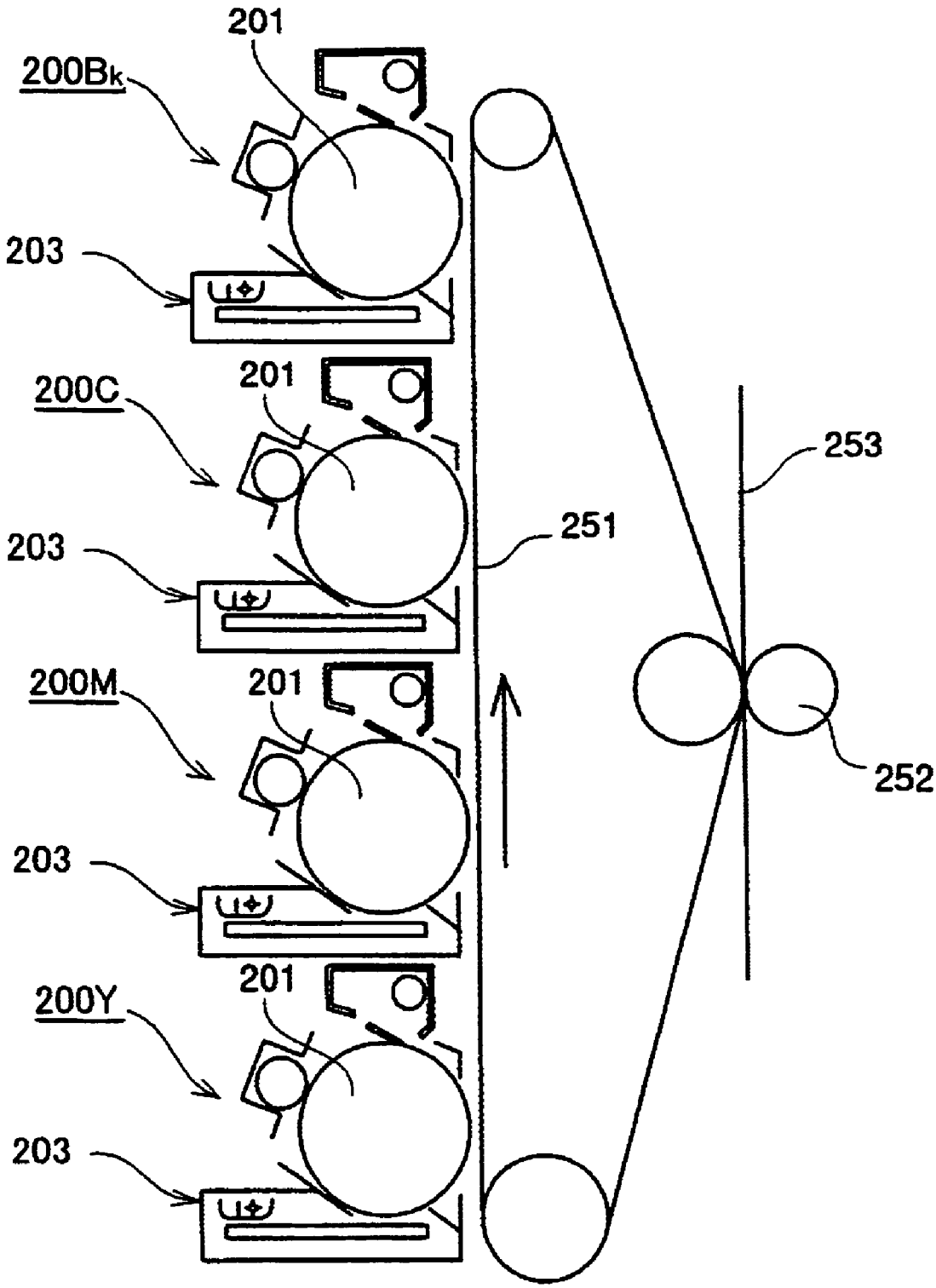
FIG. 18 is a schematic view showing a color image forming apparatus including plural process cartridges according to the present embodiment.
Figure 19:
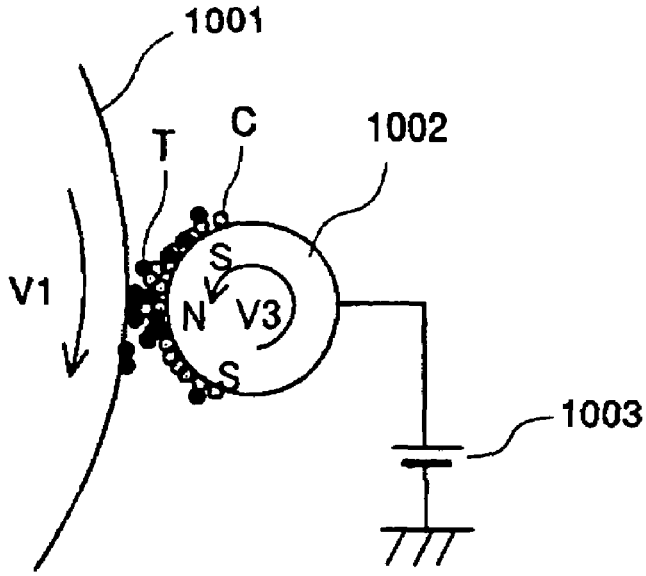
FIG. 19 illustrates an example of a developing device for applying the toner to the electrostatic latent images formed on the image carrier in an image forming apparatus of the related art.
Figure 20:
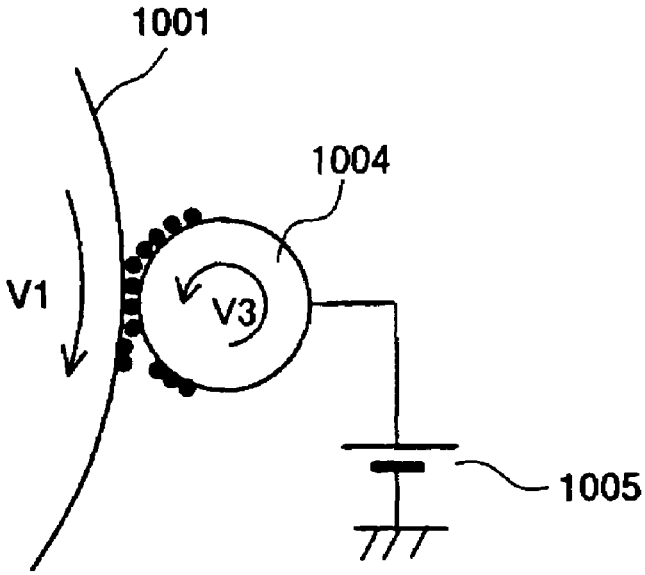
FIG. 20 illustrates another example of the developing device for applying the toner to the electrostatic latent images formed on the image carrier in an image forming apparatus of the related art.
Figure 21:
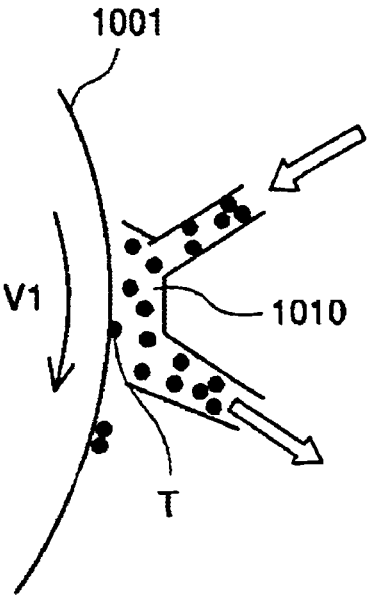
FIG. 21 illustrates still another example of applying the toner to the electrostatic latent images on the image carrier in an image forming apparatus of the related art.
Figure 22:
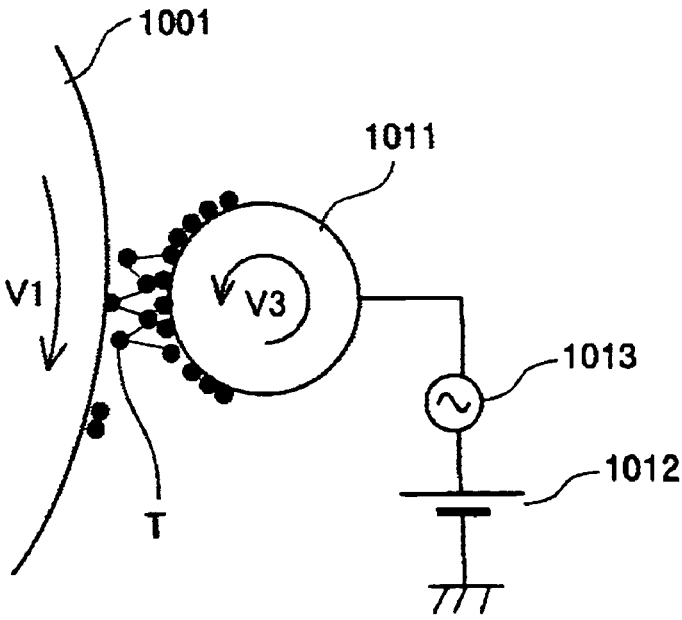
FIG. 22 illustrates yet another example of applying the toner to the electrostatic latent images on the image carrier in an image forming apparatus of the related art.

FIG. 18 is a schematic view showing a color image forming apparatus including plural the process cartridges according to the present embodiment.

As illustrated in FIG. 18, the color image forming apparatus includes a transfer belt 251 (corresponding to the image carrier) extending in the vertical direction, and along the transfer belt 251, process cartridges 200Y, 200M, 200C, 200Bk of different colors (here, yellow, magenta, cyan, black) are arranged successively in the vertical direction. Below, the process cartridges 200Y, 200M, 200C, 200Bk are collectively referred to as "process cartridge 200" where necessary. It is certain the process cartridges 200Y, 200M, 200C, 200Bk can be arranged in different order, and the process cartridge 200 may have process cartridges of other colors than yellow, magenta, cyan, black.

The toners of different colors on the image carrier 201 developed by the process cartridges 200Y, 200M, 200C, 200Bk are transferred to the vertically extending transfer belt 251, on which a transfer voltage is applied.

In this way, yellow, magenta, cyan, black images are formed and are transferred to the transfer belt 251 by multiple-transfer, and are further transferred to a transfer material 253 at one time by a transfer unit 252. Then, a not-illustrated fusing unit fuses the multiple toner images on the transfer material 253.

As described above, the image forming apparatus of the present embodiment includes the process cartridge of the present embodiment; due to this, it is possible to improve transfer efficiency and high quality developing, and thus improve image quality.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

For example, in the image forming apparatus, to which the process cartridge of the present invention is detachably attached, a device for applying a material for maintaining the surface friction coefficient of the image carrier and the electrostatic developing device may also be included.

This patent application is based on Japanese Priority Patent Application No. 2003-422783 filed on Dec. 19, 2003, the entire contents of which are hereby incorporated by reference.

What is claimed is:

1. An image forming apparatus, comprising:

an image carrying unit; and a developing unit configured to develop a latent image on the image carrying unit;

wherein a surface friction coefficient of the image carrying unit is less than or equal to 0.3, the developing unit attaches a developing agent transported by an electrostatic force to the image carrying unit to develop the latent image, a voltage applied on the transportation unit for generating the traveling wave electric field includes a pulse-shaped waveform, and a level in the pulse-shaped waveform for directing the developing agent from the transportation unit is between a voltage on the image portion of the latent image and a voltage on the non-image portion of the latent image.

2. The image forming apparatus as claimed in claim 1, wherein the developing unit includes a transportation unit configured to generate a traveling wave electric field for transferring the developing agent, said electric field not removing the developing agent adhering to an image portion of the latent image from the image carrying unit, said image portion of the latent image being to be developed to an image.

3. The image forming apparatus as claimed in claim 2, wherein the developing unit generates an electric field between the image carrying unit and the transportation unit, said electric field directing the developing agent toward the image portion of the latent image of the image carrying unit, and directing the developing agent away from a non-image portion of the latent image on the image carrying unit, said non-image portion of the latent image being not to be developed to an image.

4. The image forming apparatus as claimed in claim 3, wherein an average value of a voltage applied on the transportation unit for generating the traveling wave electric field is between a voltage on the image portion of the latent image and a voltage on the non-image portion of the latent image.

5. The image forming apparatus as claimed in claim 1, wherein a surface layer of the image carrying unit includes a material for reducing the surface friction coefficient of the image carrying unit.

6. The image forming apparatus as claimed in claim 5, wherein the material for reducing the surface friction coefficient includes a lamellar crystalline material.

7. The image forming apparatus as claimed in claim 6, wherein the lamellar crystalline material includes a fluorine-based polymeric material.

8. The image forming apparatus as claimed in claim 6, wherein the lamellar crystalline material includes a metallic soap.

9. The image forming apparatus as claimed in claim 1, further comprising:

an application unit configured to apply a material for reducing the surface friction coefficient on a surface of the image carrying unit.

10. The image forming apparatus as claimed in claim 1, wherein a roundness of the developing agent is from 0.96 to 1.00.

11. The image forming apparatus as claimed in claim 10, wherein the developing agent is produced by polymerization.

12. The image forming apparatus as claimed in claim 1, wherein the surface friction coefficient of the image carrying unit is greater than or equal to 0.1.

13. A process cartridge detachably attached to an image forming apparatus, said process cartridge comprising:

an image carrying unit; and a developing unit configured to develop a latent image on the image carrying unit;

wherein a surface friction coefficient of the image carrying unit is less than or equal to 0.3, the developing unit attaches a developing agent transported by an electrostatic force to the image carrying unit to develop the latent image, a voltage applied on the transportation unit for generating the traveling wave electric field includes a pulse-shaped waveform, and a level in the pulse-shaped waveform for directing the developing agent from the transportation unit is between a voltage on the image portion of the latent image and a voltage on the non-image portion of the latent image.

14. The process cartridge as claimed in claim 13, wherein the developing unit includes a transportation unit configured to generate a traveling wave electric field for transferring the developing agent, said electric field not removing the developing agent adhering to an image portion of the latent image from the image carrying unit, said image portion of the latent image being to be developed to an image.

15. The process cartridge as claimed in claim 14, wherein a voltage is applied on the developing unit to generate an electric field between the image carrying unit and the transportation unit, said electric field directing the developing agent toward the image portion of the latent image on the image carrying unit, and directing the developing agent away from a non-image portion of the latent image on the image carrying unit, said non-image portion of the latent image being not to be developed to an image.

16. The process cartridge as claimed in claim 15, wherein an average value of a voltage applied on the transportation unit for generating the traveling wave electric field is between a voltage on the image portion of the latent image and a voltage on the non-image portion of the latent image.

17. The process cartridge as claimed in claim 13, wherein a surface layer of the image carrying unit includes a material for reducing the surface friction coefficient of the image carrying unit.

18. The process cartridge as claimed in claim 17, wherein the material for reducing the surface friction coefficient includes a lamellar crystalline material.

19. The process cartridge as claimed in claim 18, wherein the lamellar crystalline material includes a fluorine-based polymeric material.

20. The process cartridge as claimed in claim 18, wherein the lamellar crystalline material includes a metallic soap.

21. The process cartridge as claimed in claim 13, further comprising:

an application unit configured to apply a material for reducing the surface friction coefficient on a surface of the image carrying unit.

22. The process cartridge as claimed in claim 13, wherein a roundness of the developing agent is from 0.96 to 1.00.

23. The process cartridge as claimed in claim 22, wherein the developing agent is produced by polymerization.

24. The process cartridge as claimed in claim 13, wherein the surface friction coefficient of the image carrying unit is greater than or equal to 0.1.

25. An image forming apparatus comprising a plurality of process cartridges for developing a latent image on an image carrying unit, wherein each of the process cartridges includes:

the image carrying unit; and a developing unit configured to develop the latent image; wherein a surface friction coefficient of the image carrying unit is less than or equal to 0.3, the developing unit attached a developing agent transported by an electrostatic force to the image carrying unit to develop the latent image, a voltage applied on the transportation unit for generating the traveling wave electric field includes a pulse-shaped waveform, and a level in the pulse-shaped waveform for directing the developing agent from the transportation unit is between a voltage on the image portion of the latent image and a voltage on the non-image portion of the latent image.

* * * * *